US008227054B2

(12) United States Patent
Ono et al.

(10) Patent No.: US 8,227,054 B2
(45) **Date of Patent: *Jul. 24, 2012**

(54) RECORDING MEDIUM AND MANUFACTURING METHOD THEREOF, AND INKJET RECORDING METHOD

(75) Inventors: Wataru Ono, Fujinomiya (JP); Kiyoshi Irita, Ashigarakami-gun (JP); Kaoru Tojo, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 836 days.

This patent is subject to a terminal disclaimer.

(21) Appl. No.: 12/272,365

(22) Filed: Nov. 17, 2008

(65) Prior Publication Data

US 2009/0130312 A1 May 21, 2009

(30) Foreign Application Priority Data

Nov. 19, 2007 (JP) ..... 2007-299922

(51) Int. Cl.
*B41M 5/40* (2006.01)

(52) U.S. Cl. ..... 428/32.21; 428/32.24; 428/32.25; 428/32.3; 428/32.31; 428/32.34; 428/423.1; 428/447; 428/480; 427/243; 347/105

(58) Field of Classification Search ..... 428/32.21, 428/32.24, 32.25, 32.3, 32.31, 32.34, 423.1, 428/447, 480; 427/243; 347/105
See application file for complete search history.

(56) References Cited

U.S. PATENT DOCUMENTS 6,114,047 A 9/2000 Ohta
8,034,423 B2 * 10/2011 Kawakami et al. ..... 428/32.21
2003/0203133 A1 * 10/2003 Maekawa ..... 428/32.1
2005/0069655 A1 3/2005 Yamamoto et al.
2009/0110830 A1 * 4/2009 Shimada et al. ..... 427/256

FOREIGN PATENT DOCUMENTS

| | | | |
|---|---|---|---|
| EP | 0 893 271 | A1 | 1/1999 |
| JP | 05-005297 | A | 1/1993 |
| JP | 3788508 | | 7/2003 |
| JP | 2004-010633 | A | 1/2004 |
| JP | 2005-096285 | A | 4/2005 |
| JP | 2005-238829 | A | 9/2005 |
| JP | 2006-009184 | A | 1/2006 |
| JP | 2007-119953 | A | 5/2007 |
| JP | 2007-130791 | A | 5/2007 |
| JP | 2007-160758 | A | 6/2007 |

OTHER PUBLICATIONS

Communication, dated Feb. 5, 2009, issued in related EP Application No. 08020014.0, 4 pages.

* cited by examiner

*Primary Examiner* — Betelhem Shewareged
(74) *Attorney, Agent, or Firm* — Sughrue Mion, PLLC

(57) ABSTRACT

A recording medium including a base paper, a first layer containing a binder, and a second layer containing a white pigment and an acid, formed in this order, wherein the base paper having the first layer provided thereon has a Cobb water absorbency of 2.0 g/m$^2$ or below at the surface of the first layer as determined under a contact time of 120 seconds by a water absorbency test in accordance with JIS P8140, the recording medium has a water absorption amount of from 2 mL/m$^2$ to 8 mL/m$^2$ at the surface of the second layer as determined under a contact time of 0.5 seconds in accordance with the Bristow method, and the pH at the surface of the second layer is 5.5 or below.

15 Claims, 3 Drawing Sheets

RECORDING MEDIUM AND MANUFACTURING METHOD THEREOF, AND INKJET RECORDING METHOD

CROSS-REFERENCE TO RELATED APPLICATION

This application claims priority under 35 USC 119 from Japanese Patent Application No. 2007-299922, the disclosure of which is incorporated by reference herein.

BACKGROUND OF THE INVENTION

1. Field of the Invention

The present invention relates to a recording medium and a manufacturing method thereof, and an inkjet recording method using the same.

2. Description of the Related Art

Inkjet recording apparatuses have simple structures, and inkjet recording performed by use of such inkjet recording apparatuses allows high-quality image recording. Inks used in inkjet recording are prepared so as to have viscosity in the region of several mPa·s to 30 mPa·s and designed to have surface tension in the region of 20 mN/m to 40 mN/m so that they can be discharged from inkjet heads.

In order to adjust the viscosity of an ink to fall within the above range, an ink solvent in a proportion of 50 to 90% by mass is generally mixed in each ink. Water, an organic solvent, an oil, a photopolymerizable monomer or the like can be used as the ink solvent and, in particular, water is widely used due to the comparative environmental friendliness thereof. Further, in order to avoid clogging in the discharge nozzles of an inkjet head due to drying of an ink solvent, a high boiling point solvent, such as glycerin, is generally used as an ink solvent.

However, when a large amount of ink solvent is present in a recording medium on which images are portrayed with inks, the large amount of ink solvent tends to cause image bleeding and mixing between colors. Therefore, inkjet-specific paper having a solvent absorbing layer (an ink accepting layer) provided thereon with a thickness of about 20 to 30 μm (see FIG. 5) is used as a recording medium, whereby image bleeding and mixing between colors are prevented from occurring.

In the case of water-based inks using water as an ink solvent, paper deformation such as curling occurs due to permeation of water into base paper during recording. However, as shown in FIG. 5, when the recording medium 200 has a solvent absorbing layer 22 on a base paper 21, permeation of water into the base paper can be prevented and paper deformation can be avoided.

When attempts are made to form a graphical image having a high image density and a high image-area rate, the amount of ink per unit area on a recording medium becomes large, and it becomes impossible for the solvent absorption layer to inhibit permeation of the ink solvent into the base paper. Therefore, waterproof paper covered with a resin layer, such as a polyolefin layer, (e.g., laminated paper) is generally used (see, for example, JP-A Nos. 2005-238829 and 2005-96285).

In recent years, in addition to the sectors of office printers, home printers and the like, inkjet technology has been increasingly applied to the field of commercial printing. In the field of commercial printing, prints having photograph-like surfaces that completely prevent permeation of an ink solvent into base paper are not required and, rather, a print texture such as that of printing paper for general purpose use is required. For this reason, when the solvent absorbing layer included in a recording medium has a comparatively large thickness of 20 to 30 μm, there arise limitations on, for example, the surface gloss, texture and stiffness (sturdiness) of the recording medium. Thus, application of inkjet technology in the field of commercial printing is limited to posters, ledger sheet printing and the like in which the limitations on, for example, surface gloss, texture and stiffness (sturdiness) of the recording media are less stringent.

In addition, production of the recording medium entails high costs due to the necessity of including a solvent absorbing layer and a waterproof layer, which also contribute to the above limitations.

In recent years, in particular, speeding-up of printing has been sought after, and in inkjet recording performed by use of a high-speed printing system such as a single-path system, there has been a problem whereby even the inkjet recording-specific paper discussed above cannot sufficiently absorb an ink solvent, which results in intercolor bleeding.

As a means for solving this problem, a printing method in which droplets of a liquid composition containing an acid having a function of aggregating ink are applied to a recording medium before ink droplets are applied to the recording medium has been disclosed (see, for example, JP-A No. 2004-10633). Further, a method of improving the pigment ink suitability by making a pH adjustment on the surface of an ink receiving layer has been disclosed (see, for example, JP-A No. 2007-130791).

However, none of the printing methods or the recording media disclosed in the patent documents cited above ensure water resistance enhanced to the extent that paper is prevented from deforming due to curling or the like when, for example, a large amount of ink solvent is applied thereto.

The printing method disclosed in JP-A No. 2004-10633 complicates the printing process, and not only poses an impediment to speeding-up of the process but is also problematic in terms of cost. Accordingly, it is difficult to view this method as an appropriate plan for improvements. In addition, the aggregation effect of the pigment is so strong that it results in occurrence of print failures such as a bronzing phenomenon in which areas printed in black color appear to be discolored to brown immediately after printing.

The recording medium as disclosed in JP-A No. 2007-130791 has a high P/B ratio (particles/binder ratio) in the blocking layer provided between the base paper and the ink receiving layer and, therefore, the solvent in the ink permeates into the base paper at the time of inkjet recording and causes a curling problem whereby paper deformation extends over the entire paper and a cockling problem whereby unevenness develops in parts of the paper. In particular, when forming graphical images having high image density and a high image-area rate, the amount of ink per unit area on a recording medium becomes large and the foregoing problems are further aggravated.

As discussed above, conventionally-known techniques are unable to provide inkjet recording media that can prevent image failure such as intercolor bleeding, bleeding over time and bronzing when the inkjet recording media undergo high-speed printing, and that have excellent anti-curling property.

SUMMARY OF THE INVENTION

According to an aspect of the invention, there is provided a recording medium comprising a base paper, a first layer containing a binder, and a second layer containing a white pigment and an acid, formed in this order, wherein the base paper having the first layer provided thereon has a Cobb water absorbency of 2.0 g/m$^2$ or below at the surface of the first layer as determined under a contact time of 120 seconds by a water absorbency test in accordance with JIS P8140, the recording medium has a water absorption amount of from 2 $mL/m^2$ to 8 $mL/m^2$ at the surface of the second layer as determined under a contact time of 0.5 seconds in accordance with the Bristow method, and the pH at the surface of the second layer is 5.5 or below.

DETAILED DESCRIPTION OF THE INVENTION

The recording medium of the invention and a manufacturing method thereof, and an inkjet recording method using this recording medium are described below in detail.

<Recording Medium>

Figure 1:
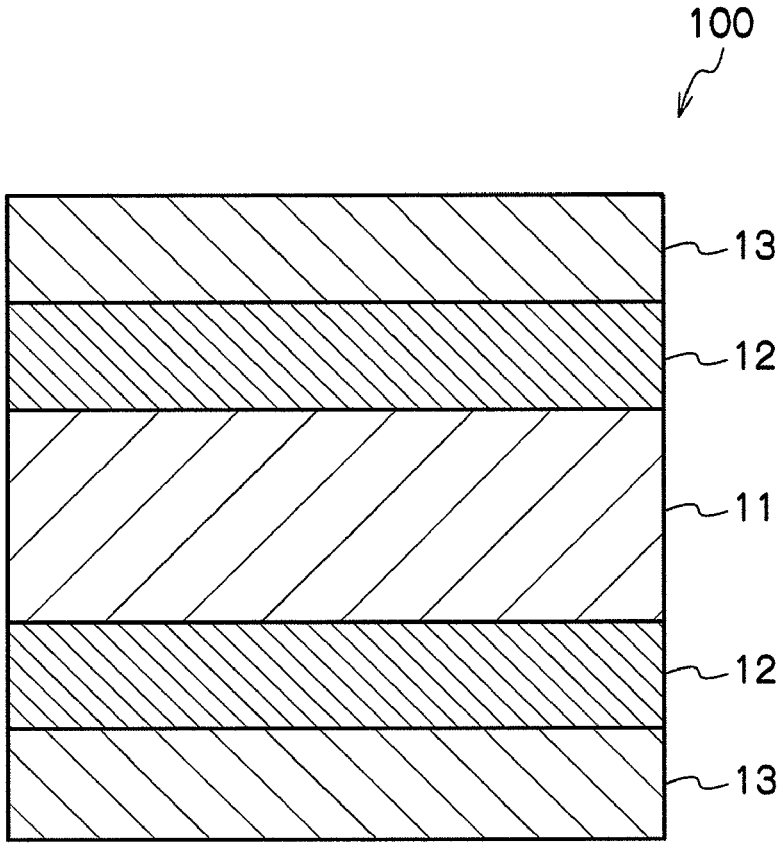
FIG. 1 is a schematic diagram showing an example of the layer structure of the recording medium of the invention.

The recording medium of the invention has a base paper, and thereon a first layer and a second layer provided in this order from the base paper side, and further may have other layers chosen appropriately as required. For example, as a recording medium 100 shown in FIG. 1, the recording medium has wood free paper 11 as the base paper, solvent blocking layers 12 as the first layer provided on the wood free paper 11, and coat layers 13 as the second layer formed on the solvent blocking layers 12. In addition, the recording medium may be either sheet paper or roll paper.

(Base Paper)

The base paper has no particular restrictions, and can be chosen appropriately from among known ones in accordance with the intended purpose.

Pulp usable as a raw material of the base paper is preferably broad leaf tree bleached kraft pulp (LBKP) from the viewpoints of ensuring a good balance between surface smoothness, stiffness and dimensional stability (anti-curling property) of the base paper and raising them to higher levels. On the other hand, needle leaf tree bleached kraft pulp (NBKP) and broad leaf tree sulfite pulp (LBSP) can also be used.

Beating of pulp can be performed with a beater, a refiner or the like. To pulp slurry obtained after beating pulp (hereinafter may be referred to as "pulp stock"), various kinds of additives, such as a filler, a dry paper strength increasing agent, a sizing agent, a wet paper strength increasing agent, a fixing agent, a pH adjusting agent and other agents are added as required.

Examples of the filler include calcium carbonate, clay, kaolin, white clay, talc, titanium oxide, diatomaceous earth, barium sulfate, aluminum hydroxide and magnesium hydroxide.

Examples of the dry paper strength increasing agent include cationic starch, cationic polyacrylamide, anionic polyacrylamide, amphoteric polyacrylamide and carboxyl-modified polyvinyl alcohol.

Examples of the sizing agent include fatty acid salts, rosin, rosin derivatives such as maleic rosin, paraffin wax, alkylketene dimers, alkenylsuccinic anhydrides (ASA), and epoxidized fatty acid amides.

Examples of the wet paper strength increasing agent include polyaminepolyamide epichlorohydrin, melamine resin, urea resin, and epoxidized polyamide resin.

Examples of the fixing agent include polyvalent metal salts such as aluminum sulfate and aluminum chloride, and cationic polymers such as cationic starch.

Examples of the pH adjusting agent include sodium hydroxide and sodium carbonate.

Examples of the other agents include an antifoaming agent, dyes, a slime controlling agent, and a fluorescent brightener.

In addition, a softener can also be added to the pulp stock as required. Descriptions of softeners can be found, e.g., in Shin Kami Kako Binran (which might be literally translated to "New Handbook of Paper Conversion"), pp. 554-555, compiled by Shigyo Times (1980).

A treatment liquid used for surface sizing treatment may contain, e.g., a water-soluble polymer, a sizing agent, a water-resistant substance, a pigment, a pH adjusting agent, a dye and a fluorescent brightener.

Examples of the water-soluble polymer include cationic starch, polyvinyl alcohol, carboxyl-modified polyvinyl alcohol, carboxymethyl cellulose, hydroxyethyl cellulose, cellulose sulfate, gelatin, casein, sodium polyacrylate, sodium salt of styrene-maleic anhydride copolymer, and sodium polystyrene sulfonate.

Examples of the sizing agent include petroleum resin emulsions, ammonium salts of styrene-maleic anhydride copolymer alkyl esters, rosin, higher fatty acid salts, alkylketene dimers (AKDs), and epoxidized fatty acid amides.

Examples of the water-resistant substance include latexes and emulsions of styrene-butadiene copolymer, ethylene-vinyl acetate copolymer, polyethylene and vinylidene chloride copolymers, and polyamidepolyamine epichlorohydrin.

Examples of the pigment include calcium carbonate, clay, kaolin, talc, barium sulfate, and titanium oxide.

Examples of the pH adjusting agent include hydrochloric acid, sodium hydroxide, and sodium carbonate.

Examples of a material for the base paper include not only the papers made from natural pulps as described above but also synthetic pulp papers, papers made from natural pulp-synthetic pulp mixtures, and various kinds of combination papers.

The thickness of the base paper is preferably from 30 to 500 μm, more preferably from 50 to 300 μm, still more preferably from 70 to 200 μm.

(First Layer)

The recording medium of the invention has a first layer on the base paper. By providing the first layer on the base paper, permeation of an ink solvent into the base paper can be inhibited. For example, a recording medium having a coat layer composed mainly of polyethylene resin on the base paper surface is known as paper having a solvent-blocking layer on base paper. However, the paper to which a water-resistant property is imparted by providing the solvent-blocking layer, though almost perfect in the effect of preventing water permeation, is not necessarily satisfactory for the texture of paper.

The first layer contains at least a binder, and the base paper having the first layer provided thereon has a Cobb water absorbency of 2.0 $g/m^2$ or below at the surface of the first layer as determined under a contact time of 120 seconds by a water absorbency test in accordance with JIS P8140, the disclosure of which is incorporated by reference herein. This Japanese Industrial Standard specifies the testing method for water absorptiveness of paper and board when one surface of non-absorptive paper and board is exposed to water for a specified period of time. Water absorptiveness (Cobb value) is the calculated mass of water absorbed in a specified time by 1 $m^2$ of paper or board under specified conditions. The apparatus arrangement is such that there is 1) immediate contact of water with part of test piece submitted to the test 2) controlled rapid removal of unabsorbed water from the test piece; 3) rapid removal of test piece without risk of contact of water outside the test piece; and 4) a cylinder with enough high not to make water overflow when 10 mm depth of water is put. The first layer has no particular restriction so long as it has the Cobb water absorbency in the range specified above, and can be appropriately chosen from among known ones in accordance with the intended purpose.

In addition to the binder, the first layer may contain other ingredients such as a white pigment as required.

From the viewpoint of inhibiting permeation of an ink solvent and ensuring good surface properties, it is preferable that the first layer in the invention contains a thermoplastic resin (preferably a latex, more preferably a polyester-based urethane latex or an acrylic silicone latex) as the binder and kaolin as the white pigment and has a ratio (x/y) between the mass x of the thermoplastic resin (solid content) and the mass y of kaolin in a range of 1 to 30.

—Binder—

The first layer contains at least one kind of binder. The binder is used for not only the dispersion purpose but also the purpose of enhancing the coating strength.

Examples of the binder include polyvinyl alcohol (including modified polyvinyl alcohols such as acetoacetyl-modified, carboxyl-modified, itaconic acid-modified, maleic acid-modified, silica-modified or amino group-modified polyvinyl alcohol), methyl cellulose, carboxymethyl cellulose, starch (including denatured starch), gelatin, gum arabic, casein, hydrolysis products of styrene-maleic anhydride copolymer, polyacrylamide, and saponification products of vinyl acetate-polyacrylic acid copolymer. In addition, latexes of synthetic polymers such as styrene-butadiene copolymer, vinyl acetate copolymers, acrylonitrile-butadiene copolymer, methyl acrylate-butadiene copolymer and polyvinylidene chloride can also be included in examples of the binder.

Examples of the above polyvinyl alcohols include polyvinyl alcohol obtained by saponifying a lower alcohol solution of polyvinyl acetate and derivatives thereof, and further saponification products of copolymers of vinyl acetate and monomers copolymerizable with vinyl acetate. Examples of the monomers copolymerizable with vinyl acetate include unsaturated carboxylic acids, such as maleic acid (anhydride), fumaric acid, crotonic acid, itaconic acid and (meth) acrylic acid, and esters thereof; α-olefins, such as ethylene and propylene; olefinsulfonic acids, such as (meth)allylsulfonic acid, ethylenesulfonic acid and sulfonic acid malate; alkali salts of olefinsulfonic acid, such as sodium(meth)allylsulfonate, sodium ethylenesulfonate, sodium sulfonate (meth)acrylate, sodium sulfonate monoalkylmalate, and sodium disulfonate alkylmalate; amido group-containing monomers, such as N-methylolacrylamide and alkali metal salts of acrylamidoalkylsulfonic acids; and N-vinylpyrrolidone derivatives.

Of the polyvinyl alcohol derivatives, acetoacetyl-modified polyvinyl alcohol can be generally produced by adding diketene in a liquid or gas state to a solution, dispersion or powder of the polyvinyl alcohol-type resins and allowing them to react with each other. The acetylation degree of the acetoacetyl-modified polyvinyl alcohol, though can be chosen appropriately in accordance with the desired quality, is preferably from 0.1 mole % to 20 mole %, more preferably from 0.5 mole % to 10 mole %.

Further, the binder can be selected appropriately from among known thermoplastic resins or latexes thereof, which include not only thermoplastic polymers for general purpose use, examples thereof including polyolefins such as homopolymers of α-olefins, such as polyethylene, polypropylene and polyvinyl chloride, and mixtures thereof, polyamides or polyimides, and polyesters including polyethylene terephthalate; but also homopolymers of esters of α-methylenealiphatic monocarboxylic acids, such as methyl(meth) acrylate, ethyl(meth)acrylate, butyl(meth)acrylate, dodecyl (meth)acrylate, octyl(meth)acrylate and phenyl(meth) acrylate; styrenes, such as styrene, chlorostyrene and vinylstyrene; vinyl esters, such as vinyl acetate, vinyl propionate, vinyl benzoate and vinyl butyrate; vinyl ethers, such as vinyl methyl ether, vinyl ethyl ether and vinyl butyl ether; or vinyl ketones, such as vinyl methyl ketone, vinyl hexyl ketone and vinyl isopropenyl ketone; and any of copolymers containing the structural units described above.

Above all, thermoplastic resins are favorable in point of water shielding, and latexes are more favorable. Examples of latexes include latexes of thermoplastic resins, such as an acrylic latex, an acrylic silicone latex, an acrylepoxy latex, an acrylstyrene latex, an acryl urethane latex, a styrene-butadiene latex, an acrylonitrile-butadiene latex, a polyester-based urethane latex and a vinyl acetate latex.

Of these latexes, a polyester-based urethane latex and an acrylic silicone latex are particularly preferable from the viewpoints of providing high effect on ink solvent permeability and inhibition of cockling, and providing economical efficiency and production suitability.

The number average molecular weight of the latex as described above is preferably from 3,000 to 1,000,000, particularly preferably about 5,000 to 100,000. When the molecular weight is 3,000 or higher, the mechanical strength of the first layer may be secured, and when the molecular weight is 1,000,000 or lower, the production suitability such as dispersion stability and viscosity is advantageous.

To be more specific, the acrylic latex used may be a commercially available product, and the following water dispersion latexes, for example, can be utilized. Examples of commercially available acrylic resins include CEVIAN A4635, 46583 and 4601, manufactured by DAICEL CHEMICAL INDUSTRIES, LTD., and NIPOL Lx 811, 814, 821, 820 and 857, manufactured by ZEON CORPORATION. In particular, the acrylic emulsions of acrylic silicone latexes as disclosed in JP-A Nos. 10-264511, 2000-43409, 2000-343811 and 2002-120452 (commercially available products of which are, e.g., AQUABRID series UM7760, UM7611 and UM4901, and AQUABRID 903, AQUABRID ASi-86, AQUABRID ASi-89, AQUABRID ASi-91, AQUABRID ASi-753, AQUABRID 4635, AQUABRID 4901, AQUABRID MSi-04S, AQUABRID AU-124, AQUABRID AU-131, AQUABRID AEA-61, AQUABRID AEC-69 and AQUABRID AEC-162, manufactured by DAICEL CHEMICAL INDUSTRIES, LTD.) can also be preferably used.

Examples of commercially available polyester-based urethane latexes include HYDRAN AP series manufactured by DIC CORPORATION (e.g., HYDRAN AP-20, HYDRAN AP-30, HYDRAN AP-30F, HYDRAN AP-40(F), HYDRAN AP-50LM, HYDRAN APX-101H, HYDRAN APX-110 and HYDRAN APX-501).

Incidentally, at least one kind of thermoplastic resin selected from among the thermoplastic resins as described above is preferably used, and not only one kind alone but also two or more kinds of the thermoplastic resins may be used.

The glass transition temperature (Tg) of the thermoplastic resin used is preferably from 5° C. to 70° C., particularly preferably from 15° C. to 50° C. Especially when the Tg is within the range specified above, handling during the production, for example, becomes easy since the scum problem of a film forming liquid (e.g., a coating liquid) for formation of the first layer can be prevented from occurring, and high gloss and high planarity can be easily achieved without troubles that the desired gloss cannot be attained unless the calendering temperature is set at a considerably high value because of too high Tg, adhesion to a metal roll surface tends to occur to result in degradation of surface properties instead, and so on.

The minimum film-formation temperature of the thermoplastic resin (preferably resin particles of the latex) is preferably from 20° C. to 60° C., more preferably from 25° C. to 50° C. When the minimum film-formation temperature at which film formation can be performed is within the foregoing range, handling during the production becomes easy since the scum problem of a film forming liquid (e.g., a coating liquid) for formation of the first layer can be prevented from occurring, permeation can be inhibited when the second layer is formed thereon, the surface properties of the second layer formed by coating become good, and a layer microporous enough for speedy permeation of an ink solvent can be formed. A layer formed merely by application of a liquid (e.g., a coating liquid) does not always have satisfactory gloss, but when soft calendering treatment is performed thereto, a layer having microporousity and having high glossiness can be obtained.

The content of a binder (preferably a thermoplastic resin) in the first layer is preferably from 15 to 95 mass %, more preferably from 30 to 90 mass %, with respect to the total solids in the first layer. When the content is within the foregoing range, the gloss and planarity can be good after calendering treatment, satisfactory permeation of an ink solvent can be attained, and occurrence of bleeding over time can be more effectively prevented.

In addition, a cross-linking agent for the binder, which is chosen properly according to the kind of the binder, may be added to the first layer when required.

—Cobb Water Absorbency—

In the invention, the Cobb water absorbency at the first layer side of the base paper having the first layer provided thereon as determined under a contact time of 120 seconds by the water absorbency test in accordance with JIS P8140 is 2.0 $g/m^2$ or below. Having a Cobb water absorbency of 2.0 $g/m^2$ or below ensures slow permeation into the base paper having the first layer provided thereon, and retards absorption of an applied liquid, such as ink, thereby reducing the degree of curling.

Additionally, the Cobb water absorbency is preferably 1.0 $g/m^2$ or below, and the lower limit of the Cobb water absorbency is preferably 0.2 $g/m^2$.

The Cobb water absorbency is determined by the water absorbency test in accordance with JIS P8140, and defined as the measured value of a quantity of water absorbed on one side of the base paper, that is, on the first layer surface of the base paper having the first layer provided thereon when water is brought into contact therewith for a given time. In the invention, the contact time of water is 120 seconds.

In addition to the above component, other components such as a white pigment, a hardener and a layered inorganic compound can be used in the first layer.

—White Pigment—

Examples of the white pigment include titanium oxide, barium sulfate, barium carbonate, calcium carbonate, lithopone, alumina white, zinc oxide, silica, antimony trioxide, titanium phosphate, aluminum hydroxide, kaolin, clay, talc, magnesium oxide, and magnesium hydroxide.

Of these pigments, titanium oxide is particularly preferable in terms of whiteness degree, dispersibility and stability. In point of water shielding, kaolin is particularly preferable. Examples of commercially available kaolin include KAOBRITE90, KAOGLOSS and KAOWHITE, manufactured by SHIRAISHI CALCIUM KAISHA, LTD.

By incorporating a white pigment into the first layer, sticking of the first layer to a calender can be avoided in the calendering treatment after formation of the first layer.

The particle size of a white pigment is preferably in a range of 0.1 to 0.5 μm. When the particle size is in the range specified above, satisfactory whiteness degree and glossiness can be achieved.

Either anatase-type or rutile-type titanium oxide may be used, and these types of titanium oxide may be used in a mixed form. In addition, the titanium oxide produced by either the sulfate method or the chlorine method may be used. Further, the titanium oxide can be chosen as appropriate from titanium oxide treated by surface coating with inorganic substance, such as hydrated alumina, hydrated silicon dioxide or zinc oxide, titanium oxide treated by surface coating with organic substance, such as trimethylolmethane, trimethylolethane, trimethylolpropane or 2,4-dihydroxy-2-methylpentane, or titanium oxide treated with a siloxane such as polydimethylsiloxane.

The refractive index of a white pigment is preferably 1.5 or above. When the first layer contains a white pigment having a refractive index in the foregoing range, high-quality images can be formed.

The specific surface area of a white pigment, as determined by the BET method, is preferably smaller than 100 $m^2/g$. When the first layer contains a white pigment having a specific surface area in the foregoing range, permeation of a coating liquid at the time of formation of the second layer by coating can be inhibited, and ink absorption in the second layer can be enhanced.

The BET method is a method for surface-area measurement of powder by use of a vapor-phase adsorption method, and more specifically, a method of determining the total surface area of 1 g of a sample, namely a specific surface area, from the adsorption isotherm. The commonly-used adsorption gas is nitrogen gas, and the method of determining the amount of adsorption from a change in pressure or volume of the adsorbed gas is generally adopted. As the prominent equation expressing the isotherm of multimolecular adsorption, there is the Brunauer-Emmett-Teller equation (BET equation). Based on this equation, the amount of adsorption is determined, and multiplied by the area occupied by one adsorbed molecule on the surface. Thus, the surface area can be determined.

White pigments are used alone, or they can be used as mixtures of two or more thereof.

The suitable content of white pigment in the first layer, though depends on the kinds of the white pigment and the thermoplastic resin used and the thickness of the first layer, is preferably about 5 to 200 mass % with respect to the mass of the binder (solid content).

—Hardener—

The first layer according to the invention may contain a hardener for hardening the binder. The hardener can be selected from aldehyde compounds, 2,3-dihydroxy-1,4-dioxane and derivative thereof, or compounds having in each individual molecule two or more vinyl groups adjacent to substituents whose Hammette's substituent constant $\sigma_p$ values are positive.

By incorporating a hardener into the first layer, the recording medium produced can have enhanced water-resistant property without increasing the viscosity of a film forming liquid for formation of the first layer. Thus, coating stability of the film forming liquid for formation of the first layer is improved, and water-resistant property of the recording medium produced is also improved.

Examples of a substituent having a positive Hammette's substituent constant $\sigma_p$ include $CF_3$ group ($\sigma_p$ value: 0.54), CN group ($\sigma_p$ value: 0.66), $COCH_3$ group ($\sigma_p$ value: 0.50), COOH group ($\sigma_p$ value: 0.45), a COOR (R represents an alkyl group) group ($\sigma_p$ value: 0.45), $NO_2$ group ($\sigma_p$ value: 0.78), $OCOCH_3$ group ($\sigma_p$ value: 0.31), SH group ($\sigma_p$ value: 0.15), $SOCH_3$ group ($\sigma_p$ value: 0.49), $SO_2CH_3$ group ($\sigma_p$ value: 0.72), $SO_2NH_2$ group ($\sigma_p$ value: 0.57), $SCOCH_3$ group ($\sigma_p$ value: 0.44), F group ($\sigma_p$ value: 0.06), Cl group ($\sigma_p$ value: 0.23), Br group ($\sigma_p$ value: 0.23), I group ($\sigma_p$ value: 0.18), $IO_2$ group ($\sigma_p$ value: 0.76), $N^+(CH_3)_2$ group ($\sigma_p$ value: 0.82), and $S^+(CH_3)_2$ group ($\sigma_p$ value: 0.90).

Examples of a compound having in a single molecule at least two vinyl groups adjacent to substituents whose Hammette's substituent constant $\sigma_p$ values are positive include 2-ethylenesulfonyl-N-[2-(2-ethylenesulfonylacetylamino) ethyl]acetamide, bis-2-vinylsulfonylethyl ether, bisacryloylimide, N,N'-diacryloylurea, 1,1-bisvinylsulfonethane, ethylene-bis-acrylamide, and diacrylate and dimethacrylate compounds represented by the following structural formulae. Of these compounds, 2-ethylenesulfonyl-N-[2-(2-ethylenesulfonylacetylamino)ethyl]acetamide is particularly preferable.

Structural Formulae

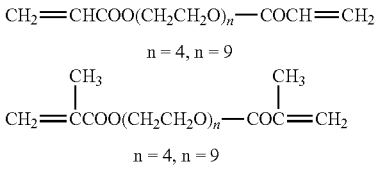

The content of a hardener in the first layer is preferably from 0.1 to 30 mass %, more preferably from 0.5 to 10 mass %, with respect to the solid content of the binder. When the content of a hardener is within the foregoing range, there occurs no increase in viscosity of a film forming liquid for formation of the first layer, and the recording medium produced can have an improved water-resistant property.

—Layered Inorganic Compound—

The first layer may further contain a layered inorganic compound. As the layered inorganic compound, a swellable inorganic layered compound is preferred, and examples thereof include swellable clay minerals, such as bentonite, hectorite, saponite, nontronite, stevensite, beidellite and montmorillonite, swellable synthetic mica and swellable synthetic smectite. The swellable inorganic layered compounds have a multilayer structure made up of unit crystal lattice layers of 1 to 1.5 nm in thickness and, because they have intra-lattice metal atom substitution to a significantly greater degree than other clay minerals, their lattice layers are lacking in positive charges, and in order to compensate for these charges, positive ions such as $Na^+$, $Ca^{2+}$ and $Mg^{2+}$ are present in an adsorbed state between lattice layers. These positive ions present between lattice layers are referred to as exchangeable cations, and can be exchanged by various cations. Especially when the cations present between lattice layers are $Li^+$, $Na^+$ and the like, the layered inorganic compounds are greatly swelled by water because those cations are small in ionic radius and binding between crystal lattice layers are weak. When shear stress is applied to such a layered inorganic compound in a swelled state, cleavage occurs with ease and a stable sol is formed in water. Bentonite and swellable synthetic mica are preferable because of strong tendency to form such stable sols. In particular, water-swellable synthetic mica is preferred.

Examples of water-swellable synthetic mica include Na tetrasic mica $NaMg_{2.5}(Si_4O_{10})F_2Na$, Li taeniolite $(NaLi)Mg_2(Si_4O_{10})F_2Na$ and Li hectorite $(NaLi)/3Mg_2/3Li_{1/3}(Si_4O_{10})F_2$.

As to the size of a water-swellable synthetic mica, the thickness is preferably from 1 to 50 nm and the face size is preferably from 1 to 20 μm. The thinner the thickness, the better the diffusion is controlled. The face size is preferably larger to the extent that no degradation is caused in smoothness and transparency of the coating surface. Therefore, the aspect ratio is preferably 100 or above, more preferably 200 or above, particularly preferably 500 or above.

When the water-swellable synthetic mica is used, the ratio between the mass x of a binder (solid content) in the first layer and the mass y of the water-swellable synthetic mica, namely the mass ratio x/y, is preferably from 1 to 30, more preferably from 5 to 15. When the mass ratio x/y is within the range specified above, great effect is produced on inhibition of oxygen permeation and blister development.

Additionally, known additives such as an antioxidant may also be added to the first layer.

The thickness of the first layer is preferably in a range of 1 to 30 μm, and more preferably in a range of 5 to 20 μm. When the thickness of the first layer is in the range specified above, the surface after calendering treatment can have enhanced glossiness, and whiteness can be obtained by a small amount of white pigment and at the same time the handling properties including bending suitability can be made equivalent to those of coated paper and art paper.

(Second Layer)

The recording medium of the invention further has a second layer on the first layer provided on the base paper.

The second layer contains at least a white pigment and an acid, and at the surface of the second layer, a water absorption amount is in a range of 2 $mL/m^2$ to 8 $mL/m^2$, as measured under a contact time of 0.5 seconds in accordance with the Bristow method, and further, at the surface of the second layer, a pH value is 5.5 or below. So long as these factors are within the foregoing ranges, the second layer has no other particular restrictions, and can be chosen from among known ones in accordance with the intended purpose.

In addition, the second layer may further contain other ingredients, such as a water-soluble polyvalent metal compound and a thermoplastic resin, as required.

The second layer in the invention is preferably, e.g., a layer further containing a water-soluble polyvalent metal compound, a layer further containing a thermoplastic resin, a layer further containing 10 to 60 parts by mass (solid content) of a thermoplastic resin per 100 parts by mass (solid content) of white pigment, a layer having a pH value of 4 or below at the surface, or the like.

—White Pigment—

The second layer contains at least one kind of white pigment. The white pigment contained in the second layer allows ink (in particular, a pigment in ink) to remain in the second layer and also the surface whiteness to increase.

The white pigment is not restricted to particular ones, and can be chosen from among those generally used as white pigments of coated paper for printing use, such as calcium carbonate, kaolin, titanium dioxide, aluminum trihydroxide, zinc oxide, barium sulfate, satin white and talc.

Of these pigment, kaolin is especially preferred in point of glossiness. Examples of commercially available kaolin include KAOBRITE90, KAOGLOSS and KAOWHITE, which are products of SHIRAISHI CALCIUM KAISHA, LTD., Contour 1500, Astra-Plate and XP03-8390, which are products of Imerys Minerals Japan K.K., and MIRAGLOSS which is a product of Engelhard Corp.

Of kaolin products, those having aspect ratios of 30 or above are preferred. The kaolin having an aspect ratio of 30 or above makes it easy to trap ink (in particular, a pigment in ink) inside the second layer, and can further enhance ink fixability.

In the case of forming images by applying the recording medium of the invention to the inkjet recording method of the invention as described hereinafter, and more specifically, in the case of forming images with ink under the condition that the pH of the second layer surface is adjusted to an acidic side (preferably 4 or below) or the treatment liquid containing an acidic substance as described below is used, the content of calcium carbonate in the second layer is preferably at most 5 mass %, more preferably at most 1 mass %, still more preferably 0 mass %, of the total pigments in the second layer from the viewpoint of avoiding bleeding and color mixing of the images formed with ink.

The content of white pigment in the second layer is preferably from 70 to 96 mass %, more preferably from 80 to 94 mass %, with respect to the total solid content in the second layer.

Additionally, the particle diameter of white pigment in the second layer is in the same range as that of white pigment in the first layer.

—Acid—

The second layer contains an acid. By containing an acid in the second layer, ink applied is aggregated and fixability thereof can be enhanced. To be more specific, in the case of using an ink containing, e.g., pigment as a coloring component, the pigment is aggregated by undergoing a pH change when ink droplets get to the second layer surface, and thereby ink bleeding over time and intercolor mixing (intercolor bleeding) can be avoided.

As the acid, known acids can be used, and examples thereof include hydrochloric acid, nitric acid, and compounds each having a phosphoric acid group, a phosphonic group, a phosphinic group, a sulfuric acid group, a sulfonic acid group, a sulfinic acid group, a carboxylic acid group, or a group derived from a salt of the above acid group. In addition, acidic polymers can also be used advantageously.

Examples of a compound having a phosphoric acid group include phosphoric acid, polyphosphoric acid, derivatives of these acids, and salts of these compounds. Examples of a compound having a carboxylic acid group include compounds each having a furan, pyrrole, pyrroline, pyrrolidone, pyrone, thiophene, indole, pyridine or quinoline structure and further having a carboxyl group as a functional group, such as pyrrolidonecarboxylic acid, pyronecarboxylic acid, pyrrolecarboxylic acid, furancarboxylic acid, pyridinecarboxylic acid, coumarinic acid, thiophenecarboxylic acid, nicotinic acid, derivatives of these compounds, and salts of these compounds.

Specifically, hydrochloric acid, sulfuric acid, nitric acid, methanesulfonic acid, phosphonic acid, phosphoric acid, polyphosphoric acid, metaphosphoric acid, oxalic acid, tartaric acid, malic acid, malonic acid, citric acid, fumaric acid, maleic acid, succinic acid, salicylic acid, phthalic acid, lactic acid, acetic acid, trichloroacetic acid, chloroacetic acid, 2-pyrrolidone-5-carboxylic acid, picolinic acid, quinolinic acid, polyacrylic acid, polysulfonic acid and polyphosphonic acid are preferable. Furthermore, methanesulfonic acid and phosphoric acid are preferable in point of rapidity of aggregation of pigment ink, oxalic acid, tartaric acid, malonic acid and citric acid are preferable in point of long-term storage and stability of paper, and succinic acid and phthalic acid are preferable in point of image fixation.

In particular, the use of an acid polymer, specifically, polyphosphoric acid, polyacrylic acid, polysulfonic acid or polyphosphonic acid, as the acid incorporated into the second layer makes the acid dispersion in paper difficult, and retards deterioration of intercolor bleeding over time and advantageous in the long storage stability of paper before being subjected to printing.

The acids described above may be used alone, or two or more kinds of them may be used in combination.

By adding these acids to a film forming liquid for use in formation of the second layer, the pH value can be adjusted to 5.5 or below. The amount of acids added may be chosen appropriately so that the second layer has a pH of 5.5 or below at the surface.

—pH—

As described above, the pH of the second layer surface is 5.5 or below for inhibiting occurrence of intercolor mixing (bleeding), but the pH is preferably 4.5 or below, more preferably 4.0 or below, particularly preferably 3.7 or below.

On the other hand, the pH of the second layer surface is preferably 2.0 or above, more preferably 2.5 or above, in order to avoid a safety problem during the handling of the recording medium, and in order to prevent print troubles such as intercolor bleeding caused by paper damage after long storage of the recording medium due to an acid having a low pH value being present in the second layer.

Measurement of pH can be made according to the method A (coating method) among the film surface pH measurements defined by Japan Technical Association of the Pulp and Paper Industry (JAPAN TAPPI). For example, pH measurement can be carried out with a pH measurement set for paper surface, Model MPC (a product of KYORITSU CHEMICAL-CHECK Lab., Corp.), which corresponds to the method A. In the case of using Model MPC, pH is determined by spreading a testing liquid over a paper surface and comparing the developed color with the standard colors.

—Water-Soluble Polyvalent Metal Compound—

From the viewpoint of inhibiting bleeding over time, it is preferable that the second layer further contains a water-soluble polyvalent metal compound. Examples of the water-soluble polyvalent metal compound include water-soluble salts of polyvalent metals, such as calcium, barium, manganese, copper, cobalt, nickel, aluminum, iron, zinc, zirconium, titanium, chromium, magnesium, tungsten and molybdenum.

To be more specific, examples include calcium acetate, calcium chloride, calcium formate, calcium sulfate, calcium lactate, barium acetate, barium sulfate, barium phosphate, manganese chloride, manganese acetate, manganese formate dihydrate, manganese ammonium sulfate hexahydrate, cupric chloride, ammonium copper(II) chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidosulfate tetrahydrate, aluminum sulfate, aluminum sulfite, aluminum thiosulfate, polyaluminum chloride, aluminum nitrate, nonahydrate, aluminum chloride hexahydrate, aluminum lactate, ferrous bromide, ferrous chloride, ferric chloride, ferrous sulfate, ferric sulfate, zinc bromide, zinc chloride, zinc nitrate hexahydrate, zinc sulfate, zirconium acetate, zirconium nitrate, basic zirconium carbonate, zirconium hydroxide, zirconium ammonium carbonate, zirconium potassium carbonate, zirconium sulfate, zirconium fluoride, zirconium chloride, zirconium chloride octahydrate, zirconium oxychloride, zirconium hydroxychloride, titanium chloride, titanium sulfate, chromium acetate, chromium sulfate, magnesium sulfate, magnesium chloride hexahydrate, magnesium citrate nonahydrate, magnesium lactate, sodium phosphotungstate, sodium tungsten citrate, 12-tungstophosphate n-hydrate, 12-tungstosilicate hexacosahydrate, molybdenum chloride, and 12-molybdophosphate n-hydrate.

Herein, the term "water-soluble" in the water-soluble polyvalent metal compound means that the compound is dissolved in water in a concentration of 1 mass % or higher at room temperature and atmospheric pressure.

As water-soluble aluminum compounds other than those described above, basic polyaluminum hydroxide compounds can be used advantageously. The main component in the basic polyaluminum hydroxide compounds is represented by the following formula 1, 2 or 3. Examples thereof are water-soluble polyaluminum hydroxides which stably contain basic polymeric polynuclear condensed ions, such as $[Al_6(OH)_{15}]^{3+}$, $[Al_8(OH)_{20}]^{4+}$, $[Al_{13}(OH)_{34}]^{5+}$ and $[Al_{21}(OH)_{60}]^{3+}$.

$$[Al_2(OH)_nCl_{6-n}]_m \quad \text{Formula 1}$$

$$[Al(OH)_3]_nAlCl_3 \quad \text{Formula 2}$$

$$Al_n(OH)_mCl_{(3n-m)} \; 0<m<3n \quad \text{Formula 3}$$

These compounds are available from TAKI CHEMICAL CO., LTD. as a water treatment chemical under the name of Polyaluminum Chloride (PAC), from Asada Chemical Industry Co., Ltd. under the name of Polyaluminum Hydroxide (Paho), and from Rikengreen Co., Ltd. under the name of PURACHEM WT. In addition, they are also offered from other makers with the same purpose, and easy to get in various grades. In the invention, those commercial items can be used as they are. Those basic polyaluminum hydroxides are also disclosed in JP-B Nos. 3-24907 and 3-42591.

Of the water-soluble polyvalent metal compounds described above, aluminum compounds and zirconium compounds, specifically basic polyaluminum hydroxide compounds, are preferable in point of water-resisting property of the image.

The amount of the water-soluble polyvalent metal compound added is preferably from 0.1 to 10 mass % based on the total solid content in the second layer.

—Other Ingredients—

In addition to the ingredients mentioned above, the second layer may contain other ingredients such as a binder.

The binder has no particular restriction. For example, the same thermoplastic resins as described in the foregoing description of the first layer can be used as the binder.

—Water Absorption Amount Determined by Bristow Method—

In the invention, the water absorption amount measured on the second layer surface under a contact time of 0.5 seconds in accordance with the Bristow method is from 2 mL/m$^2$ to 8 mL/m$^2$. Since the water absorption amount is in the range of 2 to 8 mL/m$^2$, the second layer has slow permeability. Therefore, when a liquid such as ink is applied to the second layer surface, absorption of the liquid at the applied surface can be retarded, and thereby not only the extent of curling can be reduced, but also intercolor bleeding and color mixing can be avoided. Intercolor bleeding and color mixing can be particularly effectively avoided when the pH of the second layer surface is adjusted to be in an acidic range (in particular, pH 4 or less) or a treatment liquid containing an acidic substance as mentioned hereinafter is used in combination with ink as described hereinafter.

The water absorption amount in the second layer is preferably in a range of 2 mL/m$^2$ to 4 mL/m$^2$ for the same reason as mentioned above.

The Bristow method is the method utilized as a method of measuring an amount of short-time liquid absorption, and it is adopted also by Japan Technical Association of the Pulp and Paper Industry (JAPAN TAPPI). For details of the testing method, the descriptions in J. TAPPI Paper, Pulp Testing Method No. 5-87, "Kami oyobi Itagami no Ekitai Kyushusei Shiken Hoho" (Bristow Method), Kamipa Gikyo-shi (JAPAN TAPPI JOURNAL) 41(8), 57-61 (1987) can be referred to. Herein, measurements are carried out by using the testing device (Bristow tester) as described in the above journal, setting the contact time at 0.5 seconds, and adjusting the head box slit width of the Bristow tester in accordance with the surface tension of ink used. Additionally, ink passing through to the back of the paper is omitted from calculation.

The thickness of the second layer is preferably in a range of 3 μm to 50 μm, and more preferably in a range of 4 μm to 40 μm. When the second layer has a thickness of 3 μm or above, reduction in water absorption amount in the second layer can be controlled, and occurrence of intercolor mixing and bleeding can be avoided. When the second layer has a thickness of 50 μm or below, handling properties such as brittleness and scratch resistance become excellent.

(Other Layers)

The recording medium of the invention may have layers other than the first and second layers. These other layers can be chosen as appropriate in response to the intended purposes.

<Manufacturing Method of Recording Medium>

The recording medium of the invention has no particular restrictions on the manufacturing method so long as the method allows manufacturing a recording medium having a layer structure in which the first layer and the second layer are laminated in this order on base paper, but it is preferably manufactured by a method including a first process of forming the first layer by applying to base paper a coating liquid containing thermoplastic resin particles and performing heating treatment in a temperature range not lower than the minimum film-formation temperature of the thermoplastic resin particles, and a second process of forming the second layer by applying to the first layer a film forming liquid containing a white pigment and an acid (a manufacturing method for the recording medium of the invention). The manufacturing method for the recording medium of the invention may further include other processes chosen appropriately when required.

—First Formation Process—

In the first formation process, a film forming liquid containing thermoplastic resin particles (a film forming liquid for formation of the first layer) is applied to base paper, and heating treatment is carried out in a temperature range not lower than the minimum film-formation temperature of the thermoplastic resin particles, thereby forming the first layer. Additionally, pressure may be applied during the heating treatment.

Details of the base paper are the same as described in the section on the first layer, and preferred embodiments thereof are also the same.

Examples of the thermoplastic resin and particles thereof include the same ones as the thermoplastic resins and their latexes usable in the first layer, and are not limited to particular ones. As to the thermoplastic resin particles, only one kind may be used alone, or two or more kinds may be used in combination.

The thermoplastic resin particles are preferably those having an average particle diameter of 10 to 200 nm. The average particle diameter of the thermoplastic resin particles as adopted herein is a value determined by dynamic light scattering method (device name: ELS-800, made by OTSUKA ELECTRONICS CO., LTD.).

The minimum film-formation temperature (MFT) of the thermoplastic resin constituting thermoplastic resin particles is preferably from 5° C. to 60° C.

The amount of the thermoplastic resin coated is preferably from 1 to 30 g/m$^2$.

In terms of prevention of cockling, improvement of bleeding over time and production suitability, the thermoplastic resin particles are preferably those containing dispersed particles of a water dispersion latex. The water dispersion latex is a dispersion prepared by dispersing a hydrophobic polymer insoluble or slightly soluble in water in the form of fine particles into an aqueous dispersion medium. The dispersion state thereof may be a state in which the polymer is emulsified in the dispersion medium, or a state in which emulsion polymerization has been carried out, or a state of a micelle dispersion, or a state in which the polymer molecules have in part hydrophilic structures and their molecular chains themselves are in a molecular dispersion. Such water dispersion latexes are described in detail in books, e.g., Gosei Jushi Emulsion, edited by Taira Okuda & Hiroshi Inagaki, published by Kobunshi Kankokai (1978), Gosei Latex no Oyo, edited by Takaaki Sugimura, Yasuo Kataoka, Sohichi Suzuki & Keiji Kasahara, published by Kobunshi Kankokai (1993), and Gosei Latex no Kagaku, written by Sohichi Muroi, published by Kobunshi Kankokai (1970), and so on.

To be more specific, a latex suitable as the water dispersion latex is at least one kind of latex selected from the group including a polyester-based urethane latex, an acrylic latex, an acrylic silicone latex, an acryl-epoxy latex, an acryl-styrene latex, an acryl-urethane latex, a styrene-butadiene latex, an acrylonitrile-butadiene latex and a vinyl acetate latex.

The number average molecular weight of the water dispersion latex is preferably from 3,000 to 1,000,000, particularly preferably about 5,000 to 100,000. When the latex has a number-average molecular weight of 3,000 or higher, it can secure the mechanical strength of the first layer; while, when the latex has a number-average molecular weight of 1,000,000 or lower, it is advantageous in production suitability such as dispersion stability, viscosity and so on.

Of the water dispersion latexes as described above, one kind or two or more kinds selected from polyester-based urethane latexes and acrylic silicone latexes are most suitably used in the first layer from the viewpoints of providing high effect on ink solvent permeability and inhibition of cockling, and ensuring economical efficiency and production suitability.

The method for applying a film forming liquid for formation of the first layer has no particular restriction so long as it allows film formation, and any of known methods, such as a coating method, an inkjet method and a dip method, may be employed. In point of smoothness of the film surface after film formation, however, the coating method using the film forming liquid for formation of the first layer as coating liquid is used advantageously.

Known coating methods are applicable to the coating method, and examples thereof include a blade coating method, a slide bead method, a curtain method, an extrusion method, an air-knife method, a roll coating method and a bar coating method.

The coating film formed according to a coating method is subjected to heating treatment in a temperature range not lower than the minimum film-formation temperature of the thermoplastic resin. The heating treatment may be carried out as drying treatment after coating, or these treatments may be carried out separately. The heating treatment may be performed in an oven kept at a temperature not lower than the minimum film-formation temperature, or by applying drying air heated up to a temperature not lower than the minimum film-formation temperature, or so on.

—Second Formation Process—

In the second formation process, a film forming liquid containing a white pigment and an acid (film forming liquid for formation of the second layer) is applied to the first layer formed in the first formation process, thereby forming the second layer. The formation of the second layer has no particular restriction so long as the second layer is formed on the first layer, and can be performed as appropriate.

The method for applying a film forming liquid for formation of the second layer has no particular restriction so long as it allows film formation, and any of known methods, such as a coating method, an inkjet method and an dip method, may be employed. From the viewpoint of achieving smoothness and high glossiness of the film surface after film formation, however, the coating method using the film forming liquid for formation of the second layer as coating liquid is used advantageously.

To the coating method, known coating methods are applicable. And examples thereof include a blade coating method (a bent method or a bevel method), a slide bead method, a curtain method, an extrusion method, an air-knife method, a roll coating method and a bar coating method. Of these methods, a blade coating method is preferred in point of practicability of high-speed coating and achievement of glossiness through promotion of the orientation when a tabular pigment, such as a layered inorganic compound, is used. In the blade coating method, since relatively great shear stress is generated at the instant of scraping and instantaneous nip pressure is applied, a large amount of water is apt to move into a paper substrate through pressurization permeation. Therefore, this coating method is especially effective for the present recording medium provided with the first layer for blocking the solvent permeation.

In addition to the first and second processes, other processes may be provided without any restrictions, and they can be chosen as appropriate in response to the intended purposes.

<Inkjet Recording Method>

The inkjet recording method according to the invention is an inkjet recording method (see FIG. 2) in which images are formed with inks on the recording medium having a layer surface pH lowered by incorporating in advance an aggregating agent (treatment liquid) containing the acid as described above into the second layer (a coating layer on the first layer). More specifically, the inkjet recording method includes an ink image forming process in which inks are applied to the recording medium of the invention in which the second layer surface is adjusted to have a pH of 5.5 or below and images are formed with the inks according to image data, and a drying elimination process in which the recording medium on which the images have been formed with the inks is dried and the ink solvent is eliminated therefrom.

Further, other processes chosen as appropriate may optionally be included.

—Ink Image Forming Process—

In the ink image forming process, the recording medium of the invention in which the second layer surface is adjusted to have a pH of 5.5 or below is used, and ink images are formed according to image data by applying inks to the second layer of this recording medium. When inks (e.g., pigment inks) are applied to the second layer, the inks (e.g., pigments therein) are aggregated by undergoing a pH change at the time when ink droplets get to the second layer surface, and thereby ink bleeding and intercolor mixing can be avoided.

The ink image forming process has no particular restrictions except that images are formed by applying inks according to image data, and can be chosen as appropriate in response to the intended purposes. For example, ink images can be formed by discharging inks by an inkjet method. The inkjet recording method is not particularly limited, and may be a charge controlling method in which ink is discharged by utilizing electrostatic attractive force, a drop-on-demand method (pressure pulse method) utilizing vibration pressure of a piezoelectric element, an acoustic inkjet method in which ink is discharged by radiation pressure generated by irradiating ink with the acoustic beams converted from electric signals, or a thermal inkjet method in which bubbles are formed by heating ink and pressure generated thereby is utilized. Additionally, examples of the inkjet recording method include a method of ejecting ink low in concentration, which is referred to as photo ink, in the form of many low-volume ink droplets, a method of improving the image quality by using a plurality of inks having substantially the same hue but different concentrations, or a method of using colorless, transparent ink.

Of those methods, the drop-on-demand method using a piezoelectric element (pressure pulse method) is preferred.

—Drying Elimination Process—

In the drying elimination process, the ink solvent in the ink image-formed recording medium is eliminated by drying. This process has no particular restriction except that the ink solvent in inks applied to the recording medium is eliminated by drying, and can be chosen as appropriate in response to the intended purposes.

The drying elimination process is carried out in a state in which the ink solvent (in particular, water) is present in or in the vicinity of the surface of the recording medium because the coating layer as the second layer in the recording medium of the invention has slow permeability. The drying elimination can be achieved, e.g., by applying drying air of a specified temperature, or by passing between a pair of heated and/or pressured rolls.

—Other Processes—

The inkjet recording method according to the invention may include processes other than the processes described above. The other processes have no particular restriction, and can be chosen as appropriate in response to the intended purposes. For example, a heat fixing process may be provided, or a treatment liquid-supplying process may be provided.

(Heat Fixing Process)

In the inkjet recording method according to the invention, after the drying elimination process, a heat fixing process for fusion-fixing of latex particles contained in ink used in the inkjet recording method can be provided further. By this heat fixing process, the fixability of ink to the recording medium can be enhanced. The heat fixing process has no particular restriction, except for the fusion-fixing, and can be chosen as appropriate in response to the intended purposes.

(Treatment Liquid-Supplying Process)

In the inkjet recording method according to the invention, before the ink image forming process, a treatment liquid-supplying process may be carried out, whereby a treatment liquid containing an acid substance may be supplied in advance to the second layer of the recording medium. The treatment liquid-supplying process has no particular restriction, except for supplying of a treatment liquid containing the acid substance as described below, and can be chosen as appropriate in response to the intended purposes.

The treatment liquid containing an acid substance may be any liquid as long as it contains an acid substance and is adjusted to have an acidic liquid property, and it is preferably an aqueous treatment liquid prepared by mixing an acid substance with an aqueous medium. The pH of the treatment liquid used in the invention is preferably 4 or below in point of prevention of ink bleeding and intercolor mixing.

As the acid substance for rendering the treatment liquid acidic, a compound having, e.g., a phosphoric acid group, a phosphonic acid group, a phosphinic acid group, a sulfuric acid group, a sulfonic acid group, a sulfinic acid group, a carboxylic acid group or a group derived from a salt thereof can be used, a compound having a phosphoric acid group or a carboxylic acid group is preferably used, and a compound having a carboxylic acid group is more preferably used.

Examples of a compound having a phosphoric acid group include phosphoric acid, polyphosphoric acid, derivatives of these acids and salts of these acids, and examples of a compound having a carboxylic acid group include compounds each having a furan, pyrrole, pyrroline, pyrrolidone, pyrone, thiophene, indole, pyridine or quinoline structure and further having a carboxyl group as a functional group, such as pyrrolidonecarboxylic acid, pyronecarboxylic acid, pyrrolecarboxylic acid, furancarboxylic acid, pyridinecarboxylic acid, coumarinic acid, thiophenecarboxylic acid, nicotinic acid, derivatives of these compounds, and salts of these compounds. And any of them may be added to the treatment liquid.

Of those acid substances, pyrrolidonecarboxylic acid, pyronecarboxylic acid, furancarboxylic acid, coumarinic acid, derivatives of these acids or salts of these acids are preferred. Additionally, such acid substances may be used alone, or as combinations of two or more thereof.

To the treatment liquid, other additives may be added so long as they don't impair the effects of the invention. Examples of such additives include known additives such as a drying inhibitor (humectant), a fading inhibitor, an emulsion stabilizer, a permeation promoter, a UV absorbent, an antiseptic, a fungicide, a pH adjuster, a surface tension controlling agent, a defoaming agent, a viscosity controlling agent, a dispersant, a dispersion stabilizer, a rust preventive, and a chelating agent.

The treatment liquid may be supplied to the whole recording surface of the recording medium, or at least a part of the recording surface in accordance with image data. The method for supplying the treatment liquid is not limited to particular ones, and any of coating methods, inkjet methods, dip methods and so on may be employed. For example, discharge of the treatment liquid by an inkjet method may be used for the supplying.

—Embodiments of Inkjet Recording Method—

Ink image forming, drying (drying of water, air blow drying) and heat fixing in the inkjet recording method according to the invention can be carried out under the following conditions.

<Ink Image Forming>

Head: 1,200 dpi/20-inch-wide full-line head

Amount of droplets discharged: Four-value recording of 0, 2.0, 3.5, 4.0 pL

Drive frequency: 30 kHz (recording medium transport speed: 635 mm/sec)

<Drying (Drying of Water, Air Blow Drying)>

Air velocity: 8 to 15 m/sec

Temperature: 40 to 80° C.

Air blow range: 640 mm (drying time: 1 second)

<Heat Fixing>

Silicone rubber roller (hardness: 50°, nip width: 5 mm)

Roller temperature: 70 to 90° C.

Pressure: 0.5 to 2.0 MPa

—Ink—

Inks used in the invention can be used for not only monochromatic image formation but also full-color image formation. In order to form full-color images, magenta color ink, cyan color ink and yellow color ink can be used. For the purpose of conditioning color tone, black color ink may be used further. In addition to yellow color, magenta color and cyan color inks, red, green, blue and white inks and the so-called special inks in the graphic arts (e.g., colorless ink) can also be used. As to compositions of the inks, each ink contains, e.g., latex particles, an organic pigment, a dispersant and a water-soluble organic solvent, and optionally other additives.

<Latex Particles>

The latex particles are, e.g., particles of a polymer dispersed in an aqueous medium, which is produced from a compound chosen from a nonionic monomer, an anionic monomer or a cationic monomer.

The term "nonionic monomer" refers to a monomeric compound having no dissociable functional group. The term "monomeric compound" is defined in a broad sense as a compound that can polymerize by itself or a compound that can polymerize with another compound. The monomeric compound is preferably a compound having an unsaturated double bond.

The term "anionic monomer" refers to a monomeric compound having an anionic group which can have negative charge. The anionic group, though it may be any group as long as it has negative charge, is preferably a phosphoric acid group, a phosphonic acid group, a phosphinic acid group, a sulfuric acid group, a sulfonic acid group, a sulfinic acid group or a carboxylic acid group, more preferably a phosphoric acid group or a carboxylic acid group, still more preferably a carboxylic acid group.

The term "cationic monomer" refers to a monomer having a cationic group that can have positive charge. The cationic group, though it may be any group as long as it has positive charge, is preferably an organic cationic substituent, more preferably a cationic group of nitrogen or phosphorus, still more preferably a pyridinium cation or an ammonium cation.

<Organic Pigment>

Examples of an orange or yellow organic pigment include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 28, C.I. Pigment Yellow 138, C.I. Pigment Yellow 151, C.I. Pigment Yellow 155, C.I. Pigment Yellow 180 and C.I. Pigment Yellow 185.

Examples of a magenta or red organic pigment include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222 and C.I. Pigment Violet 19.

Examples of a green or cyan organic pigment include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Green 7, and the siloxane-crosslinked aluminum phthalocyanine disclosed in U.S. Pat. No. 4,311,775.

Examples of a black organic pigment include C.I. Pigment Black 1, C.I. Pigment Black 6 and C.I. Pigment Black 7.

As to the average particle diameter of an organic pigment, smaller diameter is preferable in terms of transparency and color reproducibility, but larger diameter is preferable in terms of light resistance. The average particle diameter satisfying these is preferably in a range of 10 to 200 nm, more preferably in a range of 10 to 150 nm, still more preferably in a range of 10 to 100 nm. The organic pigment has no particular restriction as to the particle diameter distribution, and it may have either a broad particle diameter distribution, or a monodispersed particle diameter distribution. Two or more of organic pigments having a monodispersed particle diameter distribution may be used as a mixture.

The amount of organic pigment(s) added is preferably from 1 to 25 mass %, more preferably from 2 to 20 mass %, still more preferably from 5 to 20 mass %, particularly preferably from 5 to 15 mass %, with respect to ink.

<Dispersant>

The dispersants for the organic pigments may be either polymeric dispersants, or low molecular weight surfactant-type dispersants. Additionally, the polymeric dispersants may be either water-soluble ones, or water-insoluble ones.

The low molecular weight surfactant-type dispersants are added for the purpose of dispersing organic pigments into a water solvent with stability while keeping the ink at low viscosity. The low molecular weight dispersants are dispersants having molecular weight of 2,000 or below. And the molecular weight of low molecular weight dispersants is preferably from 100 to 2,000, more preferably from 200 to 2,000.

Each of the low molecular weight dispersants has a structure containing both hydrophilic and hydrophobic groups. At least one hydrophilic group and at least one hydrophobic group, or two or more kinds of hydrophilic groups and hydrophobic groups may be contained independently in each molecule of the low molecular weight dispersant. On the other hand, the dispersant can also have linkage groups for linking between hydrophilic and hydrophobic groups as appropriate.

The hydrophilic group may be any of anionic, cationic and nonionic groups, or it may be a betaine-type group, which is formed by combining those groups.

The anionic group may be any group as long as it has negative charge. And it is preferably a phosphoric acid group, a phosphonic acid group, a phosphinic acid group, a sulfuric acid group, a sulfonic acid group, a sulfinic acid group or a carboxylic acid group, more preferably a phosphoric acid group or a carboxylic acid group, still more preferably a carboxylic acid group.

The cationic group may be any group as long as it has positive charge. And it is preferably an organic cationic substituent, more preferably a cationic group containing nitrogen or phosphorus, still more preferably a pyridinium cation or an ammonium cation.

The nonionic group is, e.g., polyethylene oxide, polyglycerin or a portion of a sugar unit.

The hydrophilic group is preferably an anionic group. The anionic group is preferably a phosphoric acid group, a phosphonic acid group, a phosphinic acid group, a sulfuric acid group, a sulfonic acid group, a sulfinic acid group or a carboxylic acid group, more preferably a phosphoric acid group or a carboxylic acid group, still more preferably a carboxylic acid group.

In addition, when the low molecular weight dispersant has an anionic hydrophilic group, the pKa thereof is preferably 3 or above from the viewpoint of accelerating aggregation reaction through contact with an acidic treatment liquid. In the invention, the pKa of a low molecular weight dispersant is a value determined experimentally from the titration curve made by titrating a liquid prepared by dissolving 1 mmol/L of a low molecular weight dispersant in a tetrahydrofuran-water (3:2 by volume) mixture with an acid or alkali aqueous solution. When the pKa of a low molecular weight dispersant is 3 or above, at least 50% of anionic groups in theory enter into a non-dissociated state upon contact with a treatment liquid having a pH of about 3. Therefore, the solubility of the low molecular weight dispersant in water lowers markedly, and aggregation reaction occurs. In other words, aggregation reactivity is enhanced. From this viewpoint also, it is advantageous for the low molecular weight dispersant to have a carboxylic acid group as the anionic group.

The hydrophobic group has, for example, a hydrocarbon structure, a fluorocarbon structure or a silicone structure, and particularly preferably a hydrocarbon structure. These hydrophobic groups each may have either a straight-chain structure or a branched structure. In addition, the hydrophobic group may have either a single-chain structure or a multiple-chain structure. In the case of a multiple-chain structure, multiple kinds of hydrophobic groups may be present in the structure. Additionally, the hydrophobic group is preferably a hydrocarbon group containing 2 to 24 carbon atoms, more preferably a hydrocarbon group containing 4 to 24 carbon atoms, still more preferably a hydrocarbon group containing 6 to 20 carbon atoms.

As a water-soluble dispersant of polymeric dispersants, a hydrophilic high molecular compound can be used. Examples of a natural hydrophilic high molecular compound include vegetable-derived high polymers, such as gum arabic, tragacanth gum, Goor gum, karaya gum, locust bean gum, arabinogalactan, pectin and quince seed starch; marine algae-derived high polymers, such as aliginic acid, carageenan and agar-agar; animal-derived high polymers, such as gelatin, casein, albumin and collagen; and microbial high polymers, such as xanthene gum and dextran.

Examples of hydrophilic high molecular compounds derived from naturally occurring substances by modification include cellulose-based high polymers, such as methyl cellulose, ethyl cellulose, hydroxyethyl cellulose, hydroxypropyl cellulose and carboxymethyl cellulose; starch-based high polymers, such as sodium starch glycolate and sodium starch phosphate; and marine algae-derived high polymers, such as sodium alginate and propylene glycol ester of alginic acid.

Examples of a synthetic water-soluble high molecular compound usable as a polymeric dispersant include vinyl polymers such as polyvinyl alcohol, polyvinyl pyrrolidone and polyvinyl methyl ether, acrylic resins such as non-crosslinked polyacrylamide, polyacrylic acid or alkali metal salts thereof and water-soluble styrene-acrylic resin, water-soluble styrene-maleic acid resin, water-soluble vinylnaphthalene-acrylic resin, water-soluble vinylnaphthalene-maleic acid resin, polyvinyl pyrrolidone, alkali metal salts of p-naphthalenesulfonic acid-formaldehyde condensate, and high molecular compounds having in the side chains thereof salts of cationic functional groups such as quaternary ammonium and amino groups. In addition, natural high molecular compounds such as Shellac can also be used as polymeric dispersant.

Of those high molecular compounds, carboxyl group-introduced polymers such as a homopolymer of acrylic acid, methacrylic acid or styreneacrylic acid and a copolymer of such an acid and another monomer having a hydrophilic group are especially preferred as polymeric dispersants.

As a water-insoluble dispersant of polymeric dispersants, a polymer having both hydrophobic and hydrophilic moieties can be used. Examples of such a polymer include styrene-(meth)acrylic acid copolymer, styrene-(meth)acrylic acid-(meth)acrylate copolymer, (meth)acrylate-(meth)acrylic acid copolymer, polyethylene glycol-(meth)acrylate-(meth) acrylic acid copolymer, vinyl acetate-maleic acid copolymer, and styrene-maleic acid copolymer.

The weight-average molecular weight of a dispersant is preferably from 3,000 to 100,000, more preferably from 5,000 to 50,000, still more preferably from 5,000 to 40,000, particularly preferably from 10,000 to 40,000.

The mixing mass ratio between an organic pigment and a dispersant is preferably in a range of 1:0.06 to 1:3, more preferably in a range of 1:0.125 to 1:2, still more preferably in a range of 1:0.125 to 1:1.5.

<Water-Soluble Organic Solvent>

A water-soluble organic solvent is used for the purpose of avoiding drying and promoting wettability.

The water-soluble organic solvent as a drying inhibitor is used suitably in an ink discharge nozzle used in an inkjet recording method, and avoids clogging due to drying of inkjet ink.

As the drying inhibitor, a water-soluble organic solvent having a vapor pressure lower than that of water is suitable. Examples of such a drying inhibitor include polyhydric alcohols such as ethylene glycol, propylene glycol, diethylene glycol, polyethylene glycol, thiodiglycol, dithiodiglycol, 2-methyl-1,3-propanediol, 1,2,6-hexanetriol, acetylene glycol derivatives, glycerin and trimethylolpropane, lower alkyl ethers of polyhydric alcohols such as ethylene glycol monomethyl (or monoethyl) ether, diethylene glycol monomethyl (or monoethyl) ether and triethylene glycol monoethyl (or monobutyl) ether, heterocyclic compounds such as 2-pyrrolidone, N-methyl-2-pyrrolidone, 1,3-dimethyl-2-imidazolidinone and N-ethylmorpholine, sulfur-containing compounds such as sulfolane, dimethyl sulfoxide and 3-sulfolene, polyfunctional compounds such as diacetone alcohol and diethanolamine, and urea derivatives. Of these drying inhibitors, polyhydric alcohols such as glycerin and diethylene glycol are preferred. Additionally, those drying inhibitors may be used alone, or as combinations of two or more thereof. The content of these drying inhibitors in ink is preferably from 10 to 50 mass %.

On the other hand, a water-soluble organic solvent as a permeation promoter is used suitably for the purpose of allowing ink to permeate better to a recording medium (printing paper). Suitable examples of such a permeation promoter include alcohols such as ethanol, isopropanol, butanol, di-(or tri-)ethylene glycol monobutyl ether and 1,2-hexanediol, sodium laurylsulfate, sodium oleate, and nonionic surfactants. These permeation promoters can fully achieve their effect by being contained in an ink composition in a proportion of 5 to 30 mass %. Additionally, it is preferred that the permeation promoter be used in such an amount as not to cause ink bleeding or passing through paper (print-through).

In addition to the foregoing uses, a water-soluble organic solvent is used for viscosity control. Examples of a water-soluble organic solvent usable for viscosity control include monohydric alcohols (e.g., methanol, ethanol, propanol, isopropanol, butanol, isobutanol, sec-butanol, t-butanol, pentanol, hexanol, cyclohexanol, benzyl alcohol), polyhydric alcohols (e.g., ethylene glycol, diethylene glycol, triethylene glycol, polyethylene glycol, propylene glycol, dipropylene glycol, polypropylene glycol, butylene glycol, hexanediol, pentanediol, glycerin, hexanetriol, thiodiglycol), glycol derivatives (e.g., ethylene glycol monomethyl ether, ethylene glycol monoethyl ether, ethylene glycol monobutyl ether, diethylene glycol monomethyl ether, diethylene glycol monobutyl ether, propylene glycol monomethyl ether, propylene glycol monobutyl ether, dipropylene glycol monomethyl ether, triethylene glycol monomethyl ether, ethylene glycol diacetate, ethylene glycol monomethyl ether acetate, triethylene glycol monomethyl ether, triethylene glycol monoethyl ether, ethylene glycol monophenyl ether), amines (e.g., ethanolamine, diethanolamine, triethanolamine, N-methyldiethanolamine, N-ethyldiethanolamine, morpholine, N-ethylomorpholine, ethylenediamine, diethylenetriamine, triethylenetetramine, polyethyleneimine, tetramethylpropylenediamine), and other polar solvents (e.g., formamide, N,N-dimethylformamide, N,N-dimethylacetamide, dimethyl sulfoxide, sulfolane, 2-pyrrolidone, N-methyl-2-pyrrolidone, N-vinyl-2-pyrrolidone, 2-oxazolidone, 1,3-dimethyl-2-imidazolidinone, acetonitrile, acetone). Additionally, these water-soluble organic solvents may be used alone, or two or more thereof may be used in combination.

<Other Additives>

Examples of other additives include known additives such as a drying inhibitor (humectant), a fading inhibitor, an emulsion stabilizer, a permeation promoter, a UV absorbent, an antiseptic, a fungicide, a pH adjuster, a surface tension controlling agent, a defoaming agent, a viscosity controlling agent, a dispersant, a dispersion stabilizer, a rust preventive, and a chelating agent. These additives are directly added to ink when the ink is water-soluble ink. When oil-soluble dyes are used in the form of dispersion, a dye dispersion is prepared in advance, and thereto the additives are generally added. However, they may be added to an oil phase or an aqueous phase during the preparation of a dye dispersion.

A ultraviolet absorbent is used for the purpose of enhancing keeping quality of images. Examples of a compound usable as a ultraviolet absorbent include the benzotriazole compounds as disclosed in JP-A Nos. 58-185677, 61-190537, 2-782, 5-197075 and 9-34057; the benzophenone compounds as disclosed in JP-A Nos. 46-2784 and 5-194483, and U.S. Pat. No. 3,214,463; the cinnamic acid compounds as disclosed in JP-B Nos. 48-30492 and 56-21141, and JP-A No. 10-88106; the triazine compounds as disclosed in JP-A Nos. 4-298503, 8-53427, 8-239368 and 10-182621, and JP-W No. 8-501291; compounds disclosed in Research Disclosure, No. 24239; and compounds generating fluorescence by absorbing ultraviolet rays (so-called fluorescent whitening agents), such as stilbene compounds and benzoxazole compounds.

A fading inhibitor is used for the purpose of enhancing keeping quality of images. As the fading inhibitor, various kinds of organic or metal-complex fading inhibitors can be used. Examples of a compound usable as the organic fading inhibitor include hydroquinones, alkoxyphenols, dialkoxyphenols, phenols, anilines, amines, indanes, chromans, alkoxyanilines and heterocyclic compounds, and examples of a metal complex usable as the fading inhibitor include nickel complexes and zinc complexes. To be more specific, the compounds disclosed in the patents cited in Research Disclosure, No. 17643, Item VII-I and VII-J, ibid., No. 15162, ibid., No. 18716, p. 650, left column, ibid., No. 36544, p. 527, ibid., No. 307105, p. 872, ibid., No. 15162, and the compounds included in the general formula of representative compounds and exemplified compounds thereof disclosed in JP-A No. 62-215272, pp. 127-137 can be used.

Examples of a fungicide include sodium dehydroacetate, sodium benzoate, sodium pyridinethione-1-oxide, ethyl p-hydroxybenzoate, and 1,2-benzisothiazoline-3-one and salts thereof. These compounds are preferably used in ink in a concentration of 0.02 to 1.00 weight %.

As the pH adjuster, neutralizing agents (organic bases and inorganic alkalis) can be used. For the purpose of enhancing storage stability of inkjet ink, it is appropriate that the pH adjuster be added so that the inkjet ink is adjusted to pH 6-10, preferably pH 7-10.

Examples of a surface tension controlling agent include nonionic surfactants, cationic surfactants, anionic surfactants, and betaine surfactants.

For the purpose of applying ink droplets onto a recording medium in good conditions, it is appropriate that the surface tension controlling agent be added in such an amount as to control surface tension of the ink to a range of 20 to 60 mN/m, preferably a range of 20 to 45 mN/m, more preferably a range of 25 to 40 mN/m.

Examples of hydrocarbon-based surfactants suitably used include anionic surfactants, such as salts of fatty acids, alkyl sulfate, alkyl benzene sulfonate, alkyl naphthalene sulfonate, dialkyl sulfosuccinate, alkyl phosphate, naphthalenesulfonic acid-formaldehyde condensates and polyoxyethylene alkyl sulfate; and nonionic surfactants, such as polyoxyethylene alkyl ethers, polyoxyethylene alkyl aryl ethers, polyoxyethylene fatty acid esters, sorbitan fatty acid esters, polyoxyethylene sorbitan fatty acid esters, polyoxyethylene alkylamines, glycerin fatty acid esters, and oxyethylene-oxypropylene block copolymers. In addition, SURFYNOLS (Air Products & Chemicals), which is an acetylene-type polyoxyethylene oxide surfactant, is also preferably used. Further, amphoteric surfactants of amine oxide type, such as N,N-dimethyl-N-alkylamine oxide, are used advantageously.

Furthermore, the compounds described as surfactants in JP-A No. 59-157636, pp. 37-38, and Research Disclosure, No. 308119 (1989), can also be used.

On the other hand, friction resistance can also be improved by using the fluorine-containing (fluoroalkyl-containing) surfactants or the silicone surfactants as disclosed in JP-A Nos. 2003-322926, 2004-325707 and 2004-309806.

These surface tension controlling agents can also be used as antifoaming agents, and more specifically, fluorine-containing compounds, silicone compounds and chelating agents, specifically EDTA, are also usable as antifoaming agents.

Exemplified embodiments of the invention are as follows.

<1>A recording medium comprising a base paper, a first layer containing a binder, and a second layer containing a white pigment and an acid, formed in this order, wherein the base paper having the first layer provided thereon has a Cobb water absorbency of 2.0 g/m$^2$ or below at the surface of the first layer as determined under a contact time of 120 seconds by a water absorbency test in accordance with JIS P8140, the recording medium has a water absorption amount of from 2 mL/m$^2$ to 8 mL/m$^2$ at the surface of the second layer as determined under a contact time of 0.5 seconds in accordance with the Bristow method, and the pH at the surface of the second layer is 5.5 or below.

<2>The recording medium as described in <1>, wherein the acid is one or more selected from the group consisting of methanesulfonic acid and phosphoric acid.

<3>The recording medium as described in <1>, wherein the acid is one or more selected from the group consisting of oxalic acid, tartaric acid, malonic acid and citric acid.

<4>The recording medium as described in <1>, wherein the acid is one or more selected from the group consisting of succinic acid and phthalic acid.

<5>The recording medium as described in <1>, wherein the acid is one or more selected from the group consisting of polyphosphoric acid, polyacrylic acid, polysulfonic acid and polyphosphonic acid.

<6>The recording medium as described in <1>, wherein the second layer further contains a water-soluble polyvalent metal compound.

<7>The recording medium as described in <1>, wherein the binder in the first layer comprises a thermoplastic resin.

<8>The recording medium as described in <7>, wherein the thermoplastic resin is at least one selected from the group consisting of polyester-based urethane latexes and acrylic silicone latexes.

<9>The recording medium as described in <1>, wherein the first layer further contains a white pigment.

<10>The recording medium as described in <1>, wherein the white pigment is kaolin.

<11>The recording medium as described in <1>, wherein the pH at the surface of the second layer is 4 or below.

<12>A method for manufacturing the recording medium as described in <7>, the method comprising:

forming the first layer by applying to the base paper a film forming liquid containing thermoplastic resin particles and by performing a heating treatment in a temperature range not lower than a minimum film-formation temperature of the thermoplastic resin particles, and forming the second layer by applying to the first layer a film forming liquid containing the white pigment and the acid.

<13>The method as described in <12>, wherein the thermoplastic resin particles comprise at least one selected from the group consisting of polyester-based urethane latexes and acrylic silicone latexes.

<14>An inkjet recording method, comprising:

forming an ink image by applying ink to the recording medium as described in <1>according to image data, and drying and eliminating an ink solvent from the recording medium on which the ink image has been formed.

<15>The inkjet recording method as described in <14>, further comprising performing a fixing treatment with a heat roller after the application of the ink.

Therefore, the invention can provide a recording medium prevented from causing paper deformation, such as curling and cockling, and troubles of bronzing and intercolor mixing (intercolor bleeding) even when images are formed thereon at a high speed, and a manufacturing method thereof.

Furthermore, the invention can provide an inkjet recording method which can avoid causing paper deformation, such as curling and cockling, and troubles of bronzing and intercolor mixing (intercolor bleeding), at the time of recording, and allows formation of high-quality images like offset prints at low cost and high speed.

EXAMPLES

The invention will now be illustrated in greater detail by reference to the following examples. However, the invention should not be construed as being limited to the examples, so long as it is within the spirit and scope of the invention. Additionally, in the following examples, all the "parts" and "%" are by mass, and all the "polymerization degrees" are "average polymerization degrees", unless otherwise indicated.

Example 1

<Production of Inkjet Recording Medium>

—Preparation of Coating Liquid A for Formation of First Layer—

A 65% kaolin dispersion liquid was prepared by mixing 100 parts of kaolin (KAOBRITE 90, trade name, manufactured by SHIRAISHI CALCIUM KAISHA, LTD.), 3.8 parts of 0.1N sodium hydroxide (manufactured by Wako Pure Chemical Industries, Ltd.), 1.3 parts of 40% sodium polyacrylate (Aron T-50, trade name, manufactured by TOAGOSEI CO., LTD.) and 49.6 parts of water, and dispersing them by means of a non-bubbling kneader (NBK-2, trade name, made by NISSEI Corporation). Then, 5 parts of water, 7.0 parts of the 65% kaolin dispersion liquid obtained and 0.8 parts of 10% EMULGEN 109P (manufactured by Kao Corporation) were added to 100 parts of a 22.5% aqueous dispersion of polyester-based urethane latex (glass transition temperature: 49° C., minimum film-formation temperature: 29° C., trade name: HYDRAN AP-40F, manufactured by DIC Corporation), and mixed thoroughly by stirring. Thereafter, the mixed liquid obtained was kept in a liquid temperature range of 15 to 25° C. Thus, a coating liquid A for first layer formation having a solid concentration of 24.0% was obtained.

—Preparation of Coating Liquid A for Formation of Second Layer—

100 parts of kaolin (KAOBRITE 90, trade name, manufactured by SHIRAISHI CALCIUM KAISHA, LTD.) and 1.3 parts of 40% sodium polyacrylate (Aron T-50, trade name, manufactured by TOAGOSEI CO., LTD.) was mixed and dispersed into water, and thereto 100 parts of a 7% aqueous solution of PVA245 (manufactured by KURARAY CO., LTD.) and 3.5 parts of a 10% aqueous solution of EMULGEN 109P (manufactured by Kao Corporation) were added, and further hydrochloric acid was added thereto so that the second layer formed by coating had a layer surface pH of 3.5. Thus, a coating liquid a for second layer formation having a solid concentration of 27% was obtained.

—Formation of First Layer—

Each side of wood free paper having a basis weight of 81.4 g/m$^2$ (trade name: SHIRAOI, made by Nippon Paper Industries Co., Ltd.) was coated with the coating liquid A for first layer formation by means of an extrusion die coater while controlling so that the coating amount was 8.0 g/m$^2$ per one side, and then dried for 1 minute with 85° C. air blowing at a velocity of 15 m/sec, thereby forming first layers. The thus formed first layers were subjected to the following soft calendering treatment. The thickness of the thus formed first layers each was 8.1 μm.

—Formation of Second Layer—

Each side of the first layer-formed wood free paper was coated with the coating liquid a for second layer formation by means of an extrusion die coater while controlling so that the dry mass per one side was 20 g/m$^2$, and then dried for 1 minute with 70° C. air blowing at a velocity of 10 m/sec, thereby forming second layers. The thus formed second layers were subjected to the following calendering treatment. The thickness of the second layers each was 20.2 μm.

—Soft Calendering Treatment—

Soft calendering treatment was given to the first layers formed on both surfaces of the wood free paper by using a soft calender equipped with a metal roll and a resin roll in a pair under conditions that the surface temperature of the metal roll was set at 50° C. and the nip pressure was set at 50 kg/cm.

In this manner, an inkjet recording medium of the invention was produced.

<Preparation of Ink>

(1) Preparation of Cyan Pigment Ink C

—Preparation of Pigment Dispersion—

A dispersion liquid was prepared by mixing and stirring 10 g of Cyanine Blue A-22 (PB 15:3) manufactured by Dainichiseika Color & Chemicals Co., Ltd., 10.0 g of the low-molecular-weight dispersant illustrated below, 4.0 g of glycerin and 26 g of ion exchange water. Then, the dispersion liquid prepared was irradiated intermittently (irradiation: 0.5 seconds, interruption: 1.0 second) with ultrasonic waves for 2 hours by means of an ultrasonic irradiation device (Vibra-cell VC-750, made by SONICS & MATERIAL Inc., taper microchip: ϕ5 mm, amplitude: 30%), thereby further dispersing the pigment. Thus, a 20% pigment dispersion liquid was obtained.

Low-Molecular-Weight Dispersant

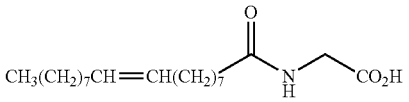

Separately from the pigment dispersion liquid, the following compounds were weighed, and mixed with stirring to prepare a mixed liquid I.

| | |
|---|---|
| Glycerin | 5.0 g |
| Diethylene glycol | 10.0 g |
| OLFINE E1010 (manufactured by Nisshin Chemical Industry Co., Ltd.) | 1.0 g |
| Ion exchange water | 11.0 g |

This mixed liquid I was slowly added dropwise to and mixed into 23.0 g of a 44% SBR dispersion liquid (acrylic acid content in polymer fine particles: 3%, Tg (glass transition temperature): 30° C.) with stirring, thereby preparing a mixed liquid II.

Then, the mixed liquid II was slowly added dropwise to and mixed into the 20% pigment dispersion liquid with stirring, thereby preparing 100 g of a pigment Ink C of cyan color (cyan ink). When the pH of the thus prepared pigment Ink C was measured with a pH meter WM-50EG made by DKK-TOA CORPORATION, the pH value was found to be 8.5.

(2) Preparation of Magenta Pigment Ink M

A pigment Ink M of magenta color (magenta ink) was prepared in the same manner as the pigment Ink C was prepared, except that Cromophtal Jet Magenta DMQ (PR-122) manufactured by Ciba Specialty Chemicals was used in place of the pigment used in preparation of the pigment Ink C. When the pH of the thus prepared pigment Ink M was measured with a pH meter WM-50EG made by DKK-TOA CORPORATION, the pH value was found to be 8.5.

(3) Preparation of Yellow Pigment Ink Y

A pigment Ink Y of yellow color (yellow ink) was prepared in the same manner as the pigment Ink C was prepared, except that Irgalite Yellow GS (PY74) manufactured by Ciba Specialty Chemicals was used in place of the pigment used in preparation of the pigment Ink C. When the pH of the thus prepared pigment Ink Y was measured with a pH meter WM-50EG made by DKK-TOA CORPORATION, the pH value was found to be 8.5.

(4) Preparation of Black Pigment Ink K

A pigment Ink K of black color (black ink) was prepared in the same manner as the pigment Ink C was prepared, except that CAB-O-JETTM_200 (carbon black), a dispersed product manufactured by Cabot Corporation, was used in place of the pigment dispersion liquid used in preparation of the pigment Ink C. When the pH of the thus prepared pigment Ink K was measured with a pH meter WM-50EG made by DKK-TOA CORPORATION, the pH value was found to be 8.5.

<Image Formation, Method for Applying Ink Droplets, and Conditions>

Figure 2:
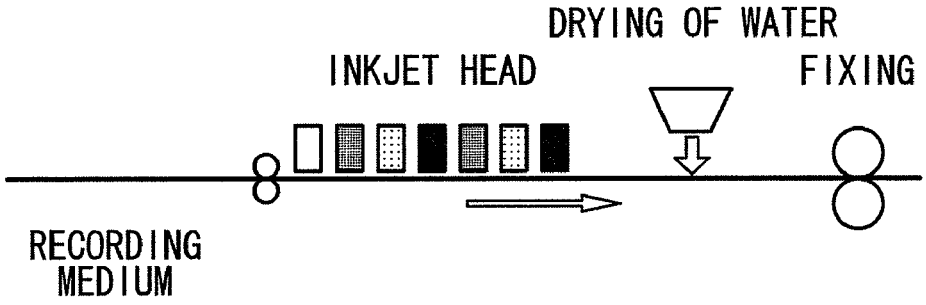
FIG. 2 is an illustration explaining an example of an inkjet recording method using the recording medium of the invention.

Four-color single-path image formation was carried out using the cyan pigment Ink C, the magenta pigment Ink M, the yellow pigment Ink Y and the black pigment Ink K, and using an apparatus as shown in FIG. 2 under the following conditions. Herein, gray-scale and character images were formed.

—Ink Image Forming—

Head: 1,200 dpi/20-inch-wide piezo full-line heads configured for 4 colors

Amount of droplet discharged: Four-value recording of 0, 2.0, 3.5 and 4.0 pL

Drive frequency: 30 kHz (recording medium transport speed: 635 mm/sec)

—Drying (Drying of Water, Air Blow Drying)—

Air velocity: 15 m/sec

Temperature: 60° C.

Air blow range: 640 mm (drying time: 1 second)

—Heat Fixing—

Silicone rubber roller (hardness: 50°, nip width: 5 mm)

Roller temperature: 90° C.

Pressure: 0.8 MPa (Evaluations)

The following evaluations 1. to 6. were performed on the inkjet recording medium produced. Evaluation results are shown in Table 1. Additionally, since both curling and cockling are phenomena caused by water applied to an inkjet recording medium, paper deformation evaluation was made on only the curling in this example.

-1. Test on Cobb Water Absorbency—

In accordance with the water absorbency test in accordance with JIS P8140, Cobb water absorbency (a permeation amount ($g/m^2$) of water when contacted with 20° C. water for 120 seconds) was measured at the surface of the first layer formed on wood free paper.

-2. Test on Water Absorption Amount at Second Layer—

The following measurement was made in accordance with the Bristow method.

Figure 3:
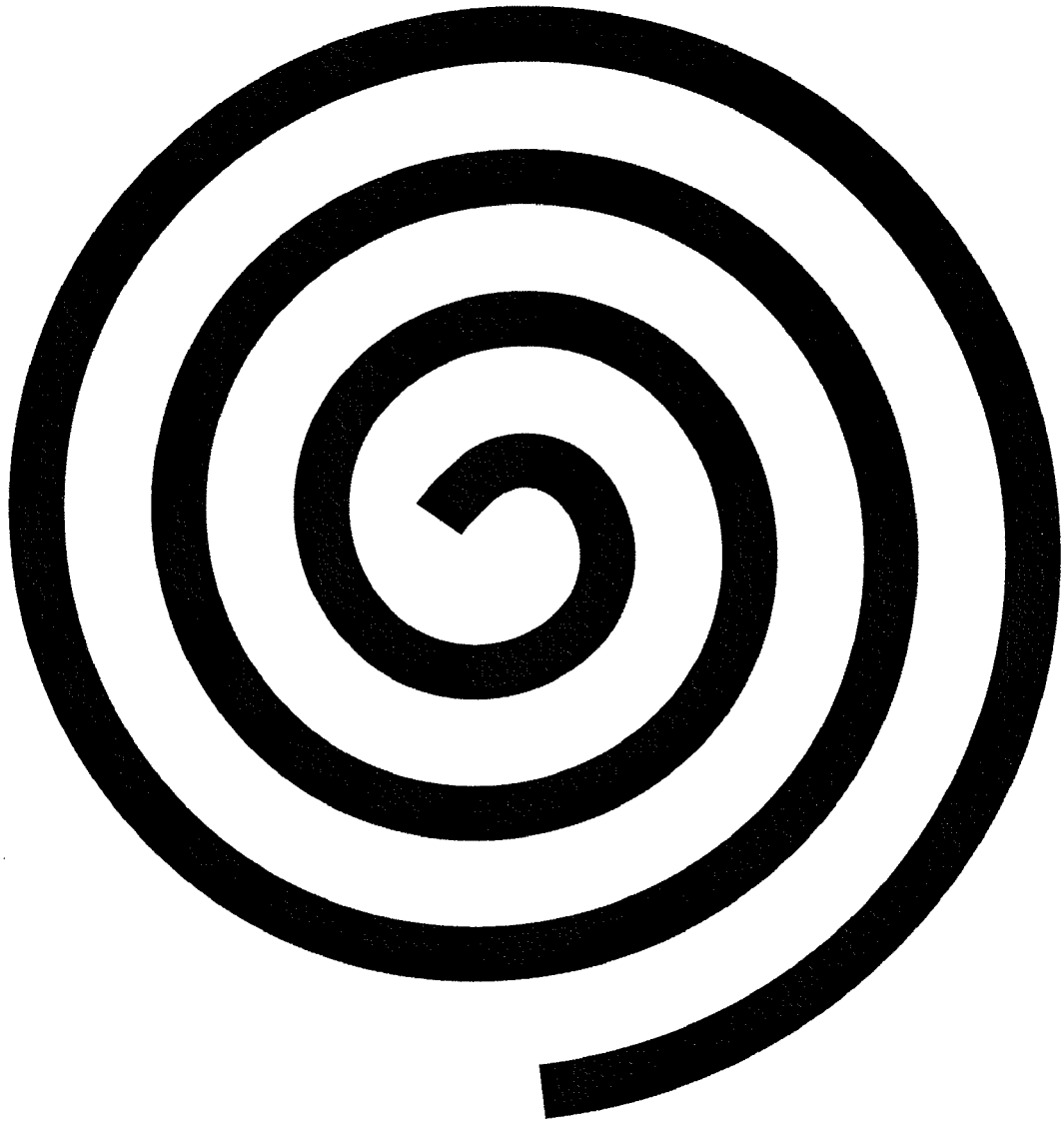
FIG. 3 is a pattern explaining the scanning line of a head charged with a testing liquid according to the Bristow method.

The inkjet recording medium obtained was cut into A6-size pieces, and the sample piece of the second layer was placed on a measuring table. After a head charged with a testing liquid was brought into contact with the sample piece placed, a liquid absorption characteristic was measured by automatically scanning the scanning line shown in FIG. 3 (from inside to outside). The relationship between a contact time and an amount of liquid absorption (water absorption) was obtained by rotating the measuring table while changing stepwise the rotational speed (paper-ink contact time). The water absorption amount at a contact time of 0.5 seconds was shown in Table 1.

-3. Test on Intercolor Bleeding—

Evaluation by visual observations was made on gray-scale and character images printed on the inkjet recording medium with reference to the following criteria.

<Evaluation Criteria>

AA: Neither image bleeding nor intercolor mixing is observed, and the Chinese character 鷹 having a size of 4 points or less can be identified.

A: Neither image bleeding nor intercolor mixing is observed, and the Chinese character 鷹 having a size of 5 points or more can be identified.

B: Slight image bleeding and intercolor mixing are observed, but they are acceptable in practical use.

C: Image bleeding and intercolor mixing are observed, and there are problems in practical use.

-4. Test on Bleeding Over Time—

A checked line pattern (line width: 0.28 mm) formed of juxtaposition of magenta ink with black ink was printed on the inkjet recording medium. Immediately after printing, the printed inkjet recording medium was inserted into a transparent PP file, and stored for 7 days in the 35° C.-80% RH surroundings. Thereafter, sensory evaluation of bleeding over time was made with reference to the following criteria.

<Evaluation Criteria>

AA: No bleeding over time is observed at all.

A: Slight bleeding over time is observed, but there are no problems in practical use.

B: Bleeding over time is observed, but there are substantially no problems in practical use.

C: Considerable bleeding over time is observed, and there are problems in practical use.

-5. Test on Paper Deformation (Curling)—

The printed inkjet recording medium was cut into sample pieces of 50 mm×5 mm size. This sample piece was coated with water in an amount of 10 g/m$^2$ in each of the MD and CD directions. In conformity with the curl curvature measuring method defined by JAPAN TAPPI, Paper Pulp Testing Method No. 15-2:2000 (Paper-Curl Testing Method—Part II), the water-coated sample piece was allowed to stand for 8 hours in the 23° C.-50% RH surroundings, and then the curling degree of the thus stored sample piece was evaluated with reference to the following criteria.

<Evaluation Criteria>

A: The curling degree is lower than 10.

B: The curling degree is from 10 to lower than 20.

C: The curling degree is from 20 to lower than 30.

D: The curling degree is 30 or higher.

-6. Test on Bronzing—

Visual observation of a cyan solid image printed at the maximum density on the inkjet recording medium was performed, and bronzing of the printed image was evaluated with reference to the following criteria.

<Evaluation Criteria>

AA: Almost no bronzing is perceivable.

A: Slight bronzing is perceivable.

B: Bronzing is perceivable, but there are no problems in practical use.

C: Bronzing is clearly perceivable, and there are problems in practical use.

Examples 2 to 28

Inkjet recording media of Examples 2 to 28 were produced in the same manner as in Example 1 and evaluated by the same methods as in Example 1, except that the acid (hydrochloric acid) added to the coating liquid a for formation of the second layer in Example 1 was replaced with the acids listed in Table 1, respectively. Evaluation results obtained are shown in Table 1.

Example 29

An inkjet recording medium of Example 29 was produced in the same manner as in Example 28, except that quinolinic acid was added in such an amount that the surface of the second layer of the inkjet recording medium was adjusted to pH 5.1, and evaluated by the same methods as in Example 28. Evaluation results obtained are shown in Table 1.

Example 30

A recording medium of Example 30 was produced in the same manner as in Example 28, except that 6.0 parts of basic polyaluminum hydroxide (a water-soluble polyvalent metal compound, PURACHEM WT, manufactured by Rikengreen Co., Ltd.) was further added to the coating liquid a for formation of the second layer, and evaluated by the same methods as in Example 28. Evaluation results obtained are shown in Table 1.

Example 31

A recording medium of Example 31 was produced in the same manner as in Example 28, except that 6.0 parts of zirconyl acetate (a water-soluble polyvalent metal compound, ZIRCOSOL ZA-20, manufactured by DAIICHI KIGENSO KAGAKU KOGYO CO., LTD.) was further added to the coating liquid a for formation of the second layer, and evaluated by the same methods as in Example 28. Evaluation results obtained are shown in Table 1.

Comparative Example 1

A recording medium of Comparative Example 1 was produced in the same manner as in Example 1, except that hydrochloric acid was not added to the coating liquid a for formation of the second layer. In addition, prior to printing of images on the recording medium, pre-coating treatment was carried out using the following treatment liquid under the following conditions, and then the image formation was performed. And evaluation of the recording medium of Comparative Example 1 was made by the same methods as in Example 1. Evaluation results obtained are shown in Table 1.

<Preparation of Treatment Liquid>

A treatment liquid was prepared by mixing the following components.

| | |
|---|---|
| Phosphoric acid | 10 g |
| Glycerin | 20 g |
| Diethylene glycol | 10 g |
| OLFINE E1010 (manufactured by Nisshin Chemical Industry Co., Ltd.) | 1 g |
| Ion exchange water | 59 g |

When the pH of the thus prepared treatment liquid was measured with a pH meter WM-50EG made by DKK-TOA CORPORATION, the pH value was found to be 1.0.

Figure 4:
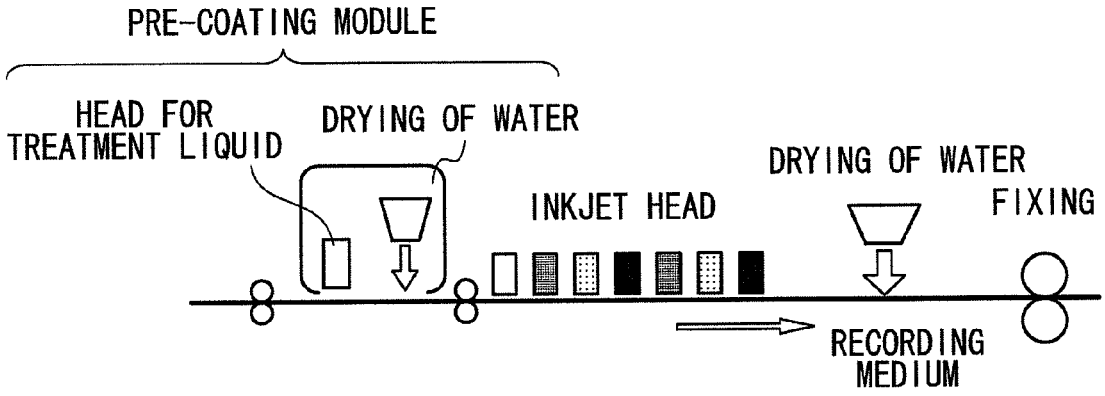
FIG. 4 is an illustration explaining an inkjet recording method employed in Comparative Example 1.
Figure 5:
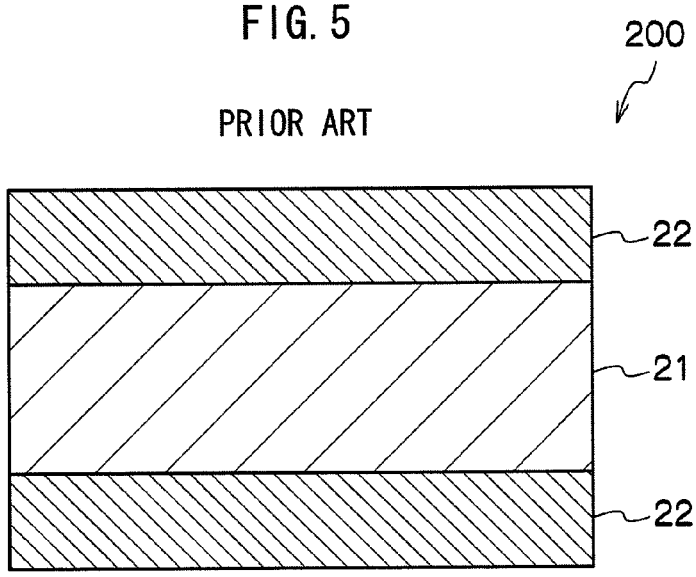
FIG. 5 PRIOR ART
FIG. 5 is a schematic diagram showing the layer structure of a conventional recording medium.

After droplets of the treatment liquid were applied onto the recording medium by using the apparatus as shown in FIG. 4 under the following conditions, image formation was performed in the same manner as in Example 1.

<Image Formation, Method for Applying Treatment Liquid Droplets, and Conditions>

—Head for Treatment Liquid Used in Pre-Coating Module—

Head: 600 dpi/20-inch-wide piezo full-line head

Amount of droplet discharged: Two-value recording of 0 and 4.0 pL

Drive frequency: 15 kHz (recording medium transport speed: 635 mm/sec)

Formed pattern: A pattern such that the treatment liquid was applied in advance to positions at which images were to be formed with one or more color inks in the ink image forming process —Drying of Water (Air Blow Drying) in Pre-Coating Module—

Air velocity: 15 m/sec

Temperature: Heating the back of the recording medium with a contact-type flat heater so that the surface temperature of the recording medium reached 60° C.

Air blow range: 450 mm (drying time: 0.7 second)

Comparative Example 2

An inkjet recording medium of Comparative Example 2 was produced in the same manner as in Example 1, except that hydrochloric acid was added to the coating liquid a for formation of the second layer so that the surface of the second layer was adjusted to pH 6.0, and evaluated by the same methods as in Example 1. Evaluation results obtained are shown in Table 1.

Comparative Example 3

An inkjet recording medium of Comparative Example 3 was produced in the same manner as in Example 1, except that hydrochloric acid was not added to the coating Liquid a for formation of the second layer, and evaluated by the same methods as in Example 1. Evaluation results obtained are shown in Table 1.

Comparative Example 4

An inkjet recording medium of Comparative Example 4 was produced in the same manner as in Example 1, except that the coating amount of the first layer was changed to 4 g/m$^2$, and evaluated by the same methods as in Example 1. Evaluation results obtained are shown in Table 1.

Comparative Example 5

An inkjet recording medium of Comparative Example 5 was produced in the same manner as in Example 1, except that the coating amount of the second layer was changed to 10 g/m$^2$, and evaluated by the same methods as in Example 1. Evaluation results obtained are shown in Table 1.

Comparative Example 6

An inkjet recording medium of Comparative Example 6 was produced in the same manner as in Example 1, except that the kaolin (trade name: KAOBRITE 90, manufactured by SHIRAISHI CALCIUM KAISHA, LTD.) of the ingredients in the coating Liquid a for formation of the second layer was replaced by titanium oxide (trade name: TIPAQUE R280, ISHIHARA SANGYO KAISHA, LTD.), and evaluated by the same methods as in Example 1. Evaluation results obtained are shown in Table 1.

TABLE 1

| | Acid | Water-soluble polyvalent metal compound | Cobb water absorbency [g/m$^2$] | Water absorption amount [mL/m$^2$] | Surface pH | Intercolor bleeding | Bleeding over time | Curling | Bronzing |
|---|---|---|---|---|---|---|---|---|---|
| Example 1 | Hydrochloric acid | — | 0.9 | 3.7 | 3.5 | A | A | A | A |
| Example 2 | Sulfuric acid | — | 0.8 | 3.8 | 3.5 | A | A | A | A |
| Example 3 | Nitric acid | — | 0.9 | 3.9 | 3.5 | A | A | A | A |
| Example 4 | Methanesulfonic acid | — | 1.0 | 3.6 | 3.5 | AA | A | A | B |
| Example 5 | Phosphonic acid | — | 0.9 | 3.7 | 3.5 | AA | A | A | B |
| Example 6 | Phosphoric acid | — | 0.8 | 3.6 | 3.5 | AA | A | A | B |
| Example 7 | Metaphosphoric acid | — | 0.8 | 3.8 | 3.5 | A | A | A | A |
| Example 8 | Oxalic acid | — | 0.9 | 3.8 | 3.5 | AA | A | A | B |
| Example 9 | Tartaric acid | — | 0.8 | 3.7 | 3.5 | AA | A | A | B |
| Example 10 | Malic acid | — | 1.0 | 3.7 | 3.5 | AA | A | A | B |
| Example 11 | Malonic acid | — | 1.0 | 3.6 | 3.5 | AA | A | A | B |
| Example 12 | Citric acid | — | 1.0 | 3.7 | 3.5 | AA | A | A | A |
| Example 13 | Fumaric acid | — | 0.8 | 3.6 | 3.5 | AA | A | A | B |
| Example 14 | Maleic acid | — | 0.9 | 3.6 | 3.5 | A | A | A | A |
| Example 15 | Succinic acid | — | 0.8 | 3.8 | 3.5 | AA | A | A | B |
| Example 16 | Salicylic acid | — | 0.9 | 3.9 | 3.5 | A | A | A | A |
| Example 17 | Phthalic acid | — | 0.9 | 3.8 | 3.5 | A | A | A | A |
| Example 18 | Lactic acid | — | 1.0 | 3.7 | 3.5 | A | A | A | A |
| Example 19 | Acetic acid | — | 1.0 | 3.6 | 3.5 | B | A | A | A |
| Example 20 | Trichloroacetic acid | — | 0.9 | 3.7 | 3.5 | A | A | A | A |
| Example 21 | Chloroacetic acid | — | 0.9 | 3.5 | 3.5 | A | A | A | A |
| Example 22 | 2-Pyrrolidone-5-carboxylic acid | — | 0.8 | 3.7 | 3.5 | A | A | A | A |
| Example 23 | Picolinic acid | — | 0.9 | 3.7 | 3.5 | AA | A | A | B |
| Example 24 | Polyphosphoric acid | — | 0.9 | 3.6 | 3.5 | AA | A | A | B |
| Example 25 | Polyacrylic acid | — | 1.0 | 3.7 | 3.5 | A | A | A | A |
| Example 26 | Polysulfonic acid | — | 0.9 | 3.8 | 3.5 | A | A | A | A |
| Example 27 | Polyphosphonic acid | — | 0.9 | 3.6 | 3.5 | A | A | A | A |
| Example 28 | Quinolinic acid | — | 1.0 | 3.8 | 3.5 | A | A | A | A |
| Example 29 | Quinolinic acid | — | 0.8 | 3.7 | 5.1 | B | A | A | A |
| Example 30 | Quinolinic acid | Basic polyaluminum hydroxide | 0.9 | 3.9 | 3.5 | A | AA | A | A |
| Example 31 | Quinolinic acid | Zirconyl acetate | 1.0 | 3.6 | 3.5 | A | AA | A | A |
| Comparative Ex. 1 | Phosphoric acid (in treatment liquid) | — | 0.9 | 3.7 | 7.2 | A | A | A | C |

TABLE 1-continued

| | Acid | Water-soluble polyvalent metal compound | Cobb water absorbency [g/m$^2$] | Water absorption amount [mL/m$^2$] | Surface pH | Intercolor bleeding | Bleeding over time | Curling | Bronzing |
|---|---|---|---|---|---|---|---|---|---|
| Comparative Ex. 2 | Hydrochloric acid | — | 1.0 | 3.7 | 6.0 | C | A | A | B |
| Comparative Ex. 3 | — | — | 1.0 | 3.6 | 7.2 | C | A | A | B |
| Comparative Ex. 4 | Hydrochloric acid | — | 4.8 | 3.8 | 3.5 | A | A | C | B |
| Comparative Ex. 5 | Hydrochloric acid | — | 0.9 | 1.7 | 3.5 | C | A | A | B |
| Comparative Ex. 6 | Hydrochloric acid | — | 0.9 | 10.8 | 3.5 | C | A | A | B |

As shown in Table 1, curling, image bleeding and intercolor bleeding are all inhibited from developing in Examples wherein the Cobb water absorbency determined under a contact time of 120 seconds by the water absorbency test in accordance with JIS P8140 is 2.0 g/m$^2$ or below, the water absorption amount at the second layer as determined under a contact time of 0.5 seconds in accordance with the Bristow method is in a range of 2 to 8 mL/m$^2$, and the surface of the second layer has a pH of 5.5 or below, in contrast to those in Comparative Examples. Moreover, by containing a water-soluble polyvalent metal compound in the second layer, bleeding over time is further improved.

What is claimed is:

1. A recording medium comprising a base paper, a first layer containing a binder, and a second layer containing a white pigment and an acid, formed in this order, wherein the base paper having the first layer provided thereon has a Cobb water absorbency of 2.0 g/m$^2$ or below at the surface of the first layer as determined under a contact time of 120 seconds by a water absorbency test in accordance with JIS P8140, the recording medium has a water absorption amount of from 2 mL/m$^2$ to 8 mL/m$^2$ at the surface of the second layer as determined under a contact time of 0.5 seconds in accordance with the Bristow method, and the pH at the surface of the second layer is 5.5 or below.

2. The recording medium as described in claim 1, wherein the acid is one or more selected from the group consisting of methanesulfonic acid and phosphoric acid.

3. The recording medium as described in claim 1, wherein the acid is one or more selected from the group consisting of oxalic acid, tartaric acid, malonic acid and citric acid.

4. The recording medium as described in claim 1, wherein the acid is one or more selected from the group consisting of succinic acid and phthalic acid.

5. The recording medium as described in claim 1, wherein the acid is one or more selected from the group consisting of polyphosphoric acid, polyacrylic acid, polysulfonic acid and polyphosphonic acid.

6. The recording medium as described in claim 1, wherein the second layer further contains a water-soluble polyvalent metal compound.

7. The recording medium as described in claim 1, wherein the binder in the first layer comprises a thermoplastic resin.

8. The recording medium as described in claim 7, wherein the thermoplastic resin is at least one selected from the group consisting of polyester-based urethane latexes and acrylic silicone latexes.

9. The recording medium as described in claim 1, wherein the first layer further contains a white pigment.

10. The recording medium as described in claim 1, wherein the white pigment is kaolin.

11. The recording medium as described in claim 1, wherein the pH at the surface of the second layer is 4 or below.

12. A method for manufacturing the recording medium as described in claim 7, the method comprising:

forming the first layer by applying to the base paper a film forming liquid containing thermoplastic resin particles and by performing a heating treatment in a temperature range not lower than a minimum film-formation temperature of the thermoplastic resin particles, and forming the second layer by applying to the first layer a film forming liquid containing the white pigment and the acid.

13. The method as described in claim 12, wherein the thermoplastic resin particles comprise at least one selected from the group consisting of polyester-based urethane latexes and acrylic silicone latexes.

14. An inkjet recording method, comprising:

forming an ink image by applying ink to the recording medium as described in claim 1 according to image data, and drying and eliminating an ink solvent from the recording medium on which the ink image has been formed.

15. The inkjet recording method as described in claim 14, further comprising performing a fixing treatment with a heat roller after the application of the ink.

* * * * *